US012090370B2

(12) United States Patent
Wong

(10) Patent No.: US 12,090,370 B2
(45) Date of Patent: Sep. 17, 2024

(54) TENNIS BALL PRESSURIZER METHOD AND APPARATUS

(71) Applicant: Hammond Wong, Yorba Linda, CA (US)

(72) Inventor: Hammond Wong, Yorba Linda, CA (US)

( * ) Notice: Subject to any disclaimer, the term of this patent is extended or adjusted under 35 U.S.C. 154(b) by 415 days.

(21) Appl. No.: 17/691,756

(22) Filed: Mar. 10, 2022

(65) Prior Publication Data

US 2023/0285809 A1 Sep. 14, 2023

(51) Int. Cl.

| | |
|---|---|
| ***A63B 39/04*** | (2006.01) |
| ***A63B 47/00*** | (2006.01) |
| *A63B 39/00* | (2006.01) |
| *A63B 102/02* | (2015.01) |

(52) U.S. Cl.
CPC ..... *A63B 39/04* (2013.01); *A63B 47/008* (2013.01); *A63B 2039/006* (2013.01); *A63B 2102/02* (2015.10)

(58) Field of Classification Search
CPC . A63B 39/04; A63B 47/008; A63B 2039/006; A63B 2102/02; A63B 47/002
See application file for complete search history.

(56) References Cited

U.S. PATENT DOCUMENTS 4,073,120 A * 2/1978 Berggren ..... A63B 39/04 53/403
4,098,048 A * 7/1978 Sawa ..... A63B 39/04 53/88
4,313,289 A * 2/1982 Birdsong, Jr. ..... A63B 39/04 73/818
4,372,095 A * 2/1983 De Satnick ..... A63B 39/04 53/79
8,627,859 B2 * 1/2014 Dirst ..... A63B 39/025 141/69
2006/0205547 A1 * 9/2006 O'Neill ..... A63B 41/04 473/604

FOREIGN PATENT DOCUMENTS

CN 214714169 U * 11/2021
EP 0282767 B1 * 10/1991
FR 2984754 A3 * 6/2013 ..... A63B 39/04

OTHER PUBLICATIONS https://www.youtube.com/watch?v=nz2FeO7Eqdw; "Repressurize Inflate And Pump Up Old Dead Tennis Balls Recycle Reduce Trash And Save Money!"; premiered Jul. 12, 2021.

* cited by examiner

*Primary Examiner* — Francis C Gray
(74) *Attorney, Agent, or Firm* — Walter J. Tencza, Jr.

(57) ABSTRACT

An apparatus having a control circuit including a computer processor and a computer memory configured with computer software. The control circuit causes a first test assembly to conduct an initial test of the air pressure within an inner chamber of a first tennis ball; and if the control circuit determines that the air pressure is below a threshold, a pressurization process increases the air pressure inside the inner chamber of the first tennis ball by piercing the outer skin of the first tennis ball with a needle, until a tip of the needle is in the inner chamber, and a first opening, plugged by the needle, is formed in the outer skin of the first tennis ball. The needle tip is thereafter withdrawn from the inner chamber of the first tennis ball, leaving the first opening unplugged and sealant is applied to the first opening to close the first opening.

17 Claims, 17 Drawing Sheets

Fig. 14

300

302

Calibration as shown by Fig. 4A and Fig. 4B

(1), Station 211 conducts MULTIPLE tests on NEW balls 105a to allow FSR 258 which is affixed on the Base plate 235 to collect AVERAGE new ball pressure data (e.g. 75 psi).
(2), The FSR 258 send data to PLC 264 to allow Sensor 213 to set an EXACT or FIXED position on the Positioner Shaft 210 ( e.g. Position X)
(3), The Calibration is now completed and the new ball is removed from Ball Slot 204 which is aligned with the FSR 258.
(4), By default. The Shaft 210 is in Extract Upward position to allow Turntable 222 to rotate to move ball to the Pressurization Station 223 after Station 211 finishes its job. The Shaft 210 Extends Downward and hold the ball in position when sensor 256 detects a ball 150a in the Ball Slot 204.

304

Deflated Ball PreTest as shown by Fig. 5A and Fig. 5B

(1), Ball Feeder 202 releases a Deflated Ball 105a into Ball Slot 204. Sensor 256 detects the ball and send out signal to 264 to allow Turntable 222 to turn, bringing the The Deflated Ball to Station 211 to be tested.
(2), Positioner Shaft 210 Extends Downward to preset Position X to allow FSR 258 to collect data of the deflated ball (e.g. 60 psi) and send the data to PLC 264 which process the data and send signal to Station 211 to allow the ball to have 15 psi of Air ( new ball 75 psi - deflated ball 60 psi). A margin of +2% or -2%, is allowed.
(3), Upon completion of the PreTest, Positioner Shaft 210 Extracts Upward to allow the ball to move onward to Pressurization Station 223 for pressurization.

306

Deflated Ball Pressurization as shown by Fig. 6A and Fig. 6B

(1), Deflated Ball 150a is detected by sensor 224 and is positioned on Ball Slot 220 (220 is a continuation of 204) by Positioner Shaft 218 to get pressurized as indicated in the Pressurization Procedure Fig. 8 through Fig. 13
(2), Soon as pressurization is completed, 15 lb of Air is injected into the ball and Positioner Shaft 218 reached the Position X which is detected by Sensor 217, Sensor 217 send signal to PLC 264 to allow Positioner Shaft Extracts Upward to allow the ball to move on to ReTesting Station for retesting.

308

Pressurized Ball Retesting as shown by Fig. 7A, Fig. 7B and Fig. C

(1), Pressurized ball 150a is brought to Retesting Station 262 by Turntable 222
(2), Positioner Shaft 219 Extends Downward to position the ball in the Ball Slot 220 to allow Sensor 237 to collect data which is sent to PLC 264 for analyzing and processing.
(3), PLC 264 analyses and gives signal to Turntable 222 to rotate. PLC 264 also gives signal to Ball Dispensor Open/Close Valve 254 to CLOSE to not allow the ball to be released through the Ball Exit 232 if the data is BELOW the Set Range as set in the NEW Ball Calibration in 302. The FAILED ball will be sent over another round of PreTest 304, Pressurization 306 and ReTesting 308 before it reaches the Set Range as set in the NEW Ball Calibration in 302 as a PASS
(4), By default. The Ball Dispenser Open/Close Valve is OPENED to allow ball to EXIT

TENNIS BALL PRESSURIZER METHOD AND APPARATUS

FIELD OF THE INVENTION

This invention relates to methods and apparatus to pressurize tennis balls.

BACKGROUND OF THE INVENTION

There are various methods and apparatuses known in the prior art to inflate balls, and/or to provide additional air to inner chambers of balls, and/or to increase the air pressure in an inner chamber within the outer skin of a ball.

For inflation or pressurization of tennis balls, existing tennis ball pressurization devices take a long time usually a couple of weeks to get the balls pressurized. These existing pressurization devices are inconsistent and the success rate is very low, i.e. lucky to get sixty percent of the tennis balls pressurized. Generally, the tennis balls, need to go back to another cycle of two plus weeks if the pressurization failed.

SUMMARY OF THE INVENTION

In at least one embodiment of the present application an apparatus is provided comprising: a control circuit including a computer processor and a computer memory configured to be programmed with computer software for controlling the computer processor; a first test assembly which is controlled by the control circuit; a pressurization assembly which is controlled by the control circuit; and a sealant assembly which is controlled by the control circuit.

In at least one embodiment, the first test assembly, which may be called a pre-test assembly, in response to the control circuit causes an initial test, or what may be called a pre-test, of the air pressure within an inner chamber of a first tennis ball when the first tennis ball is at a first location.

In at least one embodiment, the inner chamber of the first tennis ball is completely sealed and surrounded by an outer skin of the first tennis ball.

In at least one embodiment, if the control circuit determines that the air pressure within the inner chamber of the first tennis ball is below a minimum threshold when the first tennis ball is at the first location, the control circuit causes the pressurization assembly to implement a pressurization process which includes causing the pressurization assembly to insert air into the inner chamber of the first tennis ball to increase the air pressure inside the inner chamber of the first tennis ball by piercing the outer skin of the first tennis ball with a needle, until a tip of the needle is in the inner chamber, and wherein the tip of the needle and the inner chamber is surrounded by the outer skin of the first tennis ball, and a plugged first opening in the outer skin of the tennis ball, wherein the first opening has been formed by the piercing of the outer skin by the needle, and is plugged by the needle, while the tip of the needle is within the inner chamber of the first tennis ball.

In at least one embodiment, as part of the pressurization process the pressurization assembly in response to the control circuit causes the needle tip to be withdrawn from the inner chamber of the first tennis ball, leaving the first opening unplugged in the outer skin of the first tennis ball so that the inner chamber of the first tennis ball can be accessed from outside the first tennis ball through the first opening; and wherein as part of a sealant process the sealant assembly in response to the control circuit causes a sealant to be applied to the first opening in the outer skin of the first tennis ball to close the first opening to prevent air from escaping from inside the inner chamber of the tennis ball to outside the inner chamber of the first tennis ball through the combination of the outer skin and the closed first opening.

In at least one embodiment, as part of the sealant process, the sealing assembly in response to the control circuit causes air to be blown on the sealant after the sealant has been applied to the first opening of the outer skin of the first tennis ball to help the sealant dry.

The apparatus may be further comprised of a ball feeder which is configured to supply the first tennis ball to the first location for the initial test, from a plurality of tennis balls within the ball feeder.

The apparatus may be further comprised of a work station turntable which is configured to receive a first tennis ball into a ball slot; and wherein the work station turntable is configured to turn to bring the first tennis ball in the ball slot to the first location wherein the first test assembly is configured to cause the initial test of the air pressure within the inner chamber of the first tennis ball.

In at least one embodiment, the work station turntable is configured to turn to bring the first tennis ball in the ball slot to a second location, which is different from the first location, and at the second location the control circuit causes the pressurization assembly to implement the pressurization process.

The apparatus may be further comprised of a sealant anti-backflow system; an air anti-backflow system; and wherein the sealant anti-backflow system controls the sealant flow into the ball and the air anti-backflow system controls the air flow into the ball as controlled by the control circuit in a manner so that if the sealant anti-backflow system is open, then the air anti-backflow system is closed and if the air anti-back flow system is open then the sealant anti-backflow system is closed, or in some embodiments both the air anti-back flow system and the sealant anti-backflow system are closed.

The apparatus may be further comprised of a second test assembly, which may also be called a re-test assembly, which is controlled by the control circuit; and wherein the second test assembly in response to the control circuit causes a retest, or second test, of the first tennis ball, which is a test of the air pressure within the inner chamber of the first tennis ball after the first tennis ball has been subject to the pressurization process and to the sealant process.

In at least one embodiment, if the control circuit determines from the retest of the first tennis ball that the air pressure within the inner chamber of the first tennis ball is less than a threshold, then the control circuit is configured to cause the pressurization process and the sealant process to be applied to the first tennis ball again.

In at least one embodiment, a method is provided which may include determining average new ball pressure of a plurality of tennis balls during a calibration phase; determining one or more of the plurality of tennis balls is deflated, such that the one or more of the plurality of tennis balls has a pressure below a threshold pressure; and adding air pressure to inner chambers of each of the one or more of the plurality of tennis balls that were determined to be deflated so that each of the inner chambers of each of the one or more tennis balls have a minimum threshold pressure.

In at least one embodiment, a method is provided which may include performing an initial test by testing air pressure within an inner chamber of a first tennis ball when the first tennis ball is at a first location, wherein the inner chamber of the first tennis ball is completely sealed and surrounded by an outer skin of the first tennis ball.

In at least one embodiment, if it is determined by the initial test, that the air pressure within the inner chamber of the first tennis ball is below a minimum threshold when the first tennis ball is at the first location, implementing a pressurization process which includes inserting air into the inner chamber of the first tennis ball to increase the air pressure inside the inner chamber of the first tennis ball by piercing the outer skin of the first tennis ball with a needle, until a tip of the needle is in the inner chamber, and wherein the tip of the needle and the inner chamber is surrounded by the outer skin of the first tennis ball, and a plugged first opening in the outer skin of the tennis ball, wherein the first opening has been formed by the piercing of the outer skin by the needle, and is plugged by the needle, while the tip of the needle is within the inner chamber of the first tennis ball.

In at least one embodiment, the method may further include as part of the pressurization process withdrawing the needle tip from the inner chamber of the first tennis ball after sufficient air has been inserted into the inner chamber of the tennis ball, leaving the first opening unplugged in the outer skin of the first tennis ball so that the inner chamber of the first tennis ball can be accessed from outside the first tennis ball through the first opening; and as part of a sealant process, applying a sealant to the first opening in the outer skin of the first tennis ball to close the first opening to prevent air from escaping from inside the inner chamber of the tennis ball to outside the inner chamber of the first tennis ball through the combination of the outer skin and the closed first opening.

In at least one embodiment, the method may further include as part of the sealant process, blowing air on the sealant after the sealant has been applied to the first opening of the outer skin of the first tennis ball to help the sealant dry.

The method may further include feeding the first tennis ball to the first location for the initial test, from a plurality of tennis balls.

The method may further include receiving the first tennis ball into a ball slot; and bringing the first tennis ball in the ball slot to the first location wherein the first test assembly is configured to cause the initial test of the air pressure within the inner chamber of the first tennis ball.

The method may further include bringing the first tennis ball in the ball slot to a second location, which is different from the first location, and at the second location implementing the pressurization process.

The method may further include performing a retest of the first tennis ball, which is a test of the air pressure within the inner chamber of the first tennis ball after the first tennis ball has been subject to the pressurization process and to the sealant process.

The method may further include applying the pressurization process and the sealant process to the first tennis ball again if it is determined from the re-test of the first tennis ball that the air pressure within the inner chamber of the first tennis ball is less than a threshold.

BRIEF DESCRIPTION OF THE DRAWINGS

FIG. 14 is a flow chart of a first method, which includes calibration, deflated ball pre-test, deflated ball pressurization, and pressurized ball retesting in accordance with an embodiment of the present invention;

DETAILED DESCRIPTION OF THE INVENTION

Figure 1A:
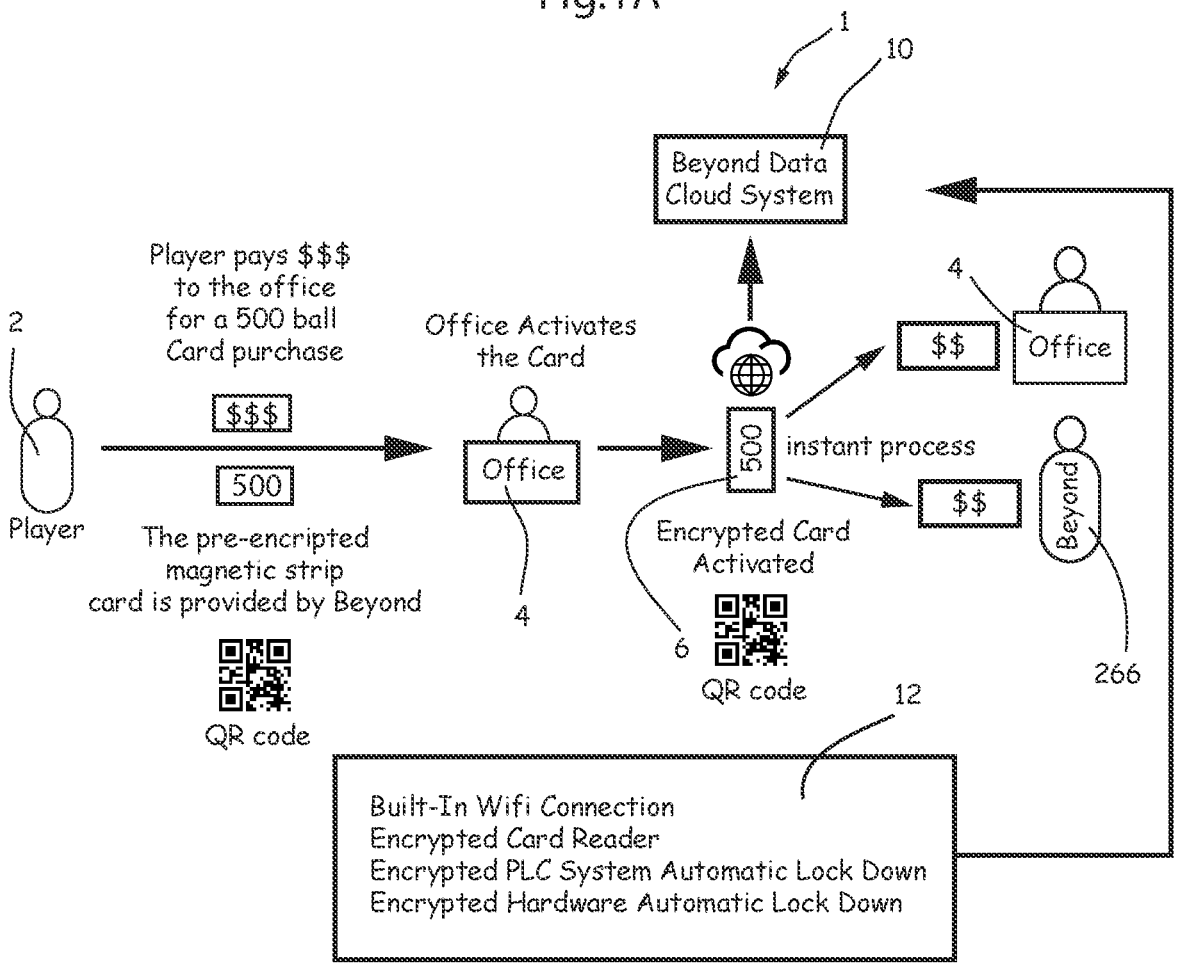
FIG. 1A shows a simplified diagram of a process for pressurizing tennis balls in accordance with an embodiment of the present invention.

FIG. 1A shows a simplified diagram of a process 1 for pressurizing tennis balls in accordance with an embodiment of the present invention.

The process 1 includes a player 2 paying money to an office 4 or the player 2 doing an online purchase through a mobile computer software phone application downloaded to the player's cell phone by the player for a five hundred ball card purchase to either receive a magnetic strip card or a QR (quick response) code through the mobile computer software phone application. The pre-encrypted magnetic card and the QR code were issued to the office 4 (and/or to a corresponding computer processor, computer memory, and/or computer server for the office 4) by Beyond 266, wherein the office 4 may be an organization, a subsidiary of Beyond or franchisee and Beyond is the franchiser. The office 4 and/or a corresponding computer processor, computer memory and/or computer server, activates the card to form activated card 6 or a QR code of equal amount. The activated card 6 or QR code which is labeled "500" for a five hundred ball card is then provided to the office 4 or to an organization which may be called "Beyond". Either the activated card 6 or the QR code is also provided to the organization's data cloud system at step 10 (wherein the data cloud system is identified as "Beyond" data cloud system to identify the organization.

Figure 1B:
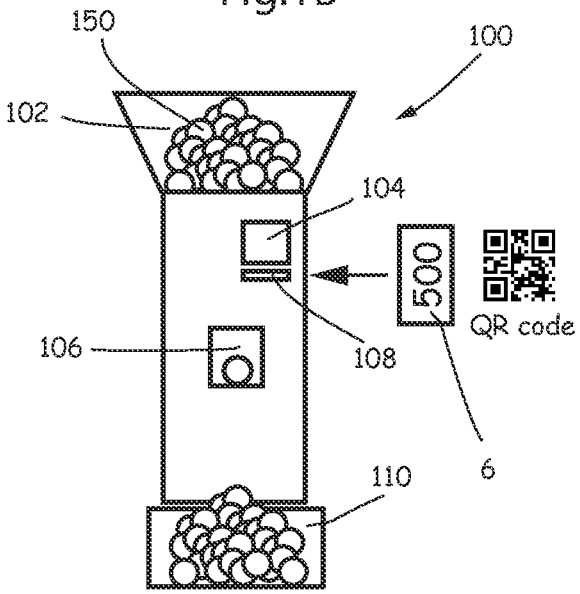
FIG. 1B shows a first apparatus, including a self-serving vending machine, for pressuring tennis balls in accordance with an embodiment of the present invention.

The block 12 represents content, such as including computer software and/or hardware inside or a part of a self-serving or vending machine of apparatus 100 shown in FIG. 1B. In at least one embodiment, the content within or part of the self-serving or vending machine of apparatus 100 includes a "Built-In Wifi connection", "Encrypted Card Reader", "Encrypted PLC System Automatic Lock Down" and "Encrypted Hardware Automatic Lock Down", one or more of which help prevent intrusion into the hardware or the system of the apparatus 100. The security system will automatically perform PLC 264 system lockdown and the hardware lockdown to avoid unauthorized access to the PLC 264 system and hardware (e.g. open secured or locked door/panel)

FIG. 1B shows a first apparatus or self-serving or vending machine 100 for pressurizing tennis balls in accordance with an embodiment of the present invention. The apparatus 100 includes a ball feeder 102, an LCD (liquid crystal display) 104 with QR code scanner feature, a ball dispenser 106, a card reader 108, and a ball collector 110. The magnetic card 6 or QR code, which has a "500" ball purchase is also shown in FIG. 1B and can be inserted into a slot for the card reader 108 or scanned on the LCD. The ball feeder 102 has a plurality of tennis balls 150 shown in FIG. 1B, wherein the balls 150 may include a ball 150*a*, shown in FIGS. 2-13.

Figure 2:
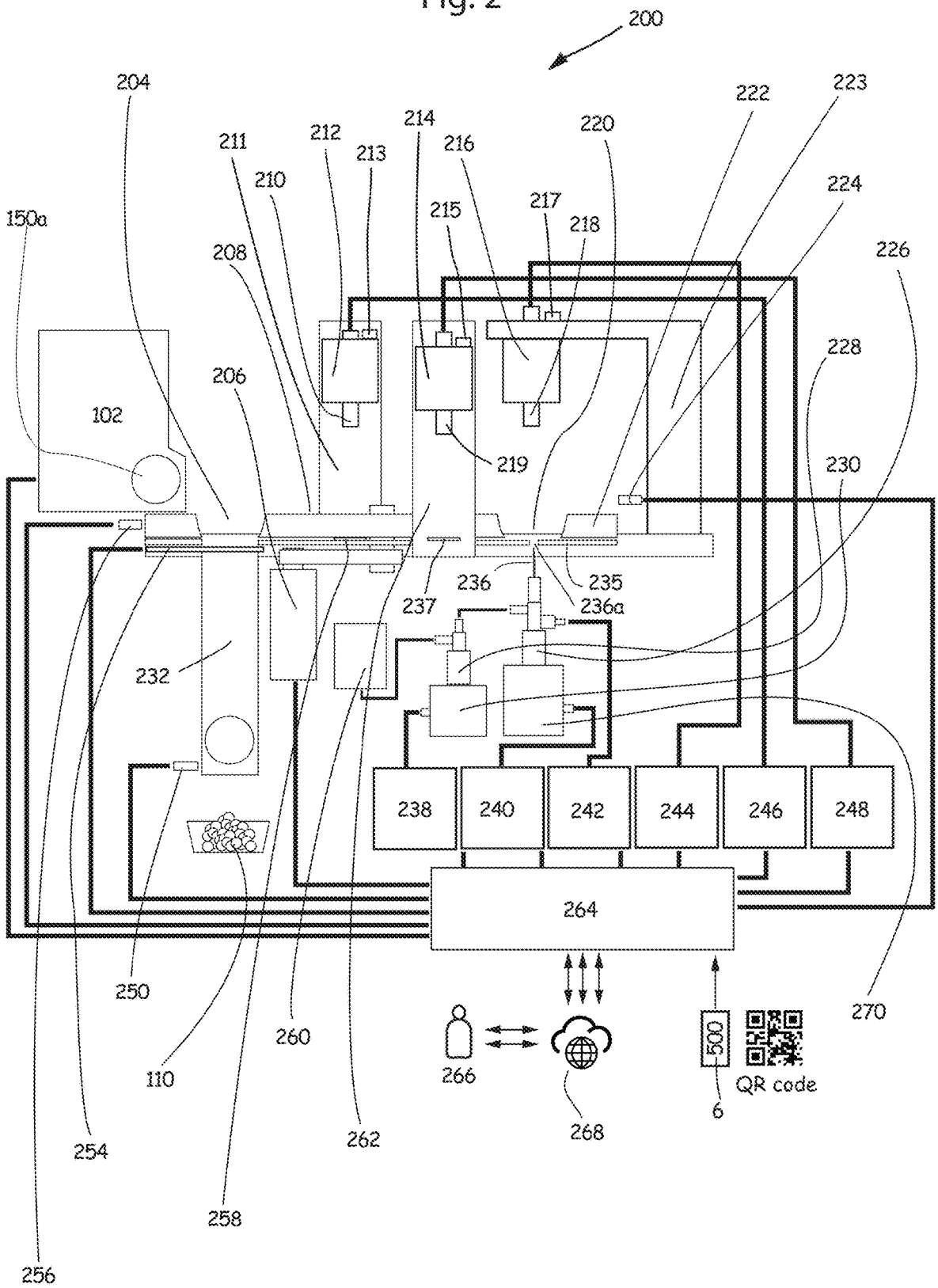
FIG. 2 shows a second apparatus for pressuring tennis balls in accordance with an embodiment of the present invention.

FIG. 2 shows a second apparatus 200 for pressuring tennis balls in accordance with an embodiment of the present invention. The second apparatus 200 may be part of, and within the apparatus or machine 100.

The second apparatus 200 includes the ball feeder 102 into which a tennis ball 150*a* is fed, a ball processing slot 204, a motor 206, a work station turntable 208, a stroke shaft 210, a pre-test assembly 212, a pressure pre-test station 211, a sensor 213, a re-retest assembly 214, a sensor 215, a pressure re-test station 262, a positioner assembly 216, a sensor 217, a stroke shaft 218, a ball processing slot 220 (which is a continuation of 204 as turntable 222 rotates), a work station turntable 222, a pressurization station 223, a photoelectric switch sensor 224, a stroke shaft 228, a sealant assembly 230, a ball dispenser 232, a needle 236, a fixed base plate 235, a needle entrance 236*a*, a solenoid valve 238, a solenoid valve 240, a solenoid valve 242, a solenoid valve 244, a solenoid valve 246, a solenoid valve 248, a count sensor 250, a ball collection bin 110, a ball dispenser open/close control 254, an approach sensor 256, a pre-test FSR (force sensing resistor) 258, a sealant container 260, a re-test force sensing resistor 237, a PLC (Programmable Logic Controller, computer processor or control circuit) 264, a system administrator 266, a network cloud 268, and a pressurization assembly 270. The magnetic card 6 and QR code from cell phone is also shown in FIG. 2.

Generally, all of the components shown in FIG. 2 connected to the control circuit or PLC 264 are in communication with the control circuit 264 and are controlled by the control circuit 264, in accordance with computer software stored in computer memory of control circuit 264 and implemented by a computer processor of control circuit 264.

The control circuit or PLC 264 controls and is in communication with at least the following components: ball feeder 102; ball processing slot 204, motor 206, work station turntable 208, stroke shaft 210, pre-test, initial or first test assembly 212, pressure pre-test station 211, a sensor 213, re-retest assembly 214, sensor 215, pressure re-test station 262, positioner assembly 216, a sensor 217, stroke shaft 218, ball processing slot 220 (which is a continuation of 204 as turntable 222 rotates), work station turntable 222, pressurization station 223, photoelectric switch sensor 224, stroke shaft 228, sealant assembly 230, ball dispenser 232, needle 236, fixed base plate 235, needle entrance 236*a*, solenoid valve 238, solenoid valve 240, solenoid valve 242, solenoid valve 244, solenoid valve 246, solenoid valve 248, count sensor 250, ball collection bin 110, ball dispenser open/close control 254, approach sensor 256, pre-test FSR (force sensing resistor) 258, sealant container 260, re-test force sensing resistor 237, system administrator 266, network cloud 268, a pressurization assembly 270; and data and/or signals may be supplied from control circuit or PLC 264 to or from at least all of the above mentioned components. Data from all of the above mentioned components or relating to all of the above mentioned components may be stored in computer memory of the control circuit or PLC 264.

In at least one embodiment, components 212, 214, 216, 230 and 270 are pneumatic air cylinders which control the positioner shafts 210, 219, 218, 226, 228 extension and extraction. The pneumatic air cylinders are controlled by solenoid valves 238, 240, 242, 244, 246 and 248, respectively.

Figure 3A:
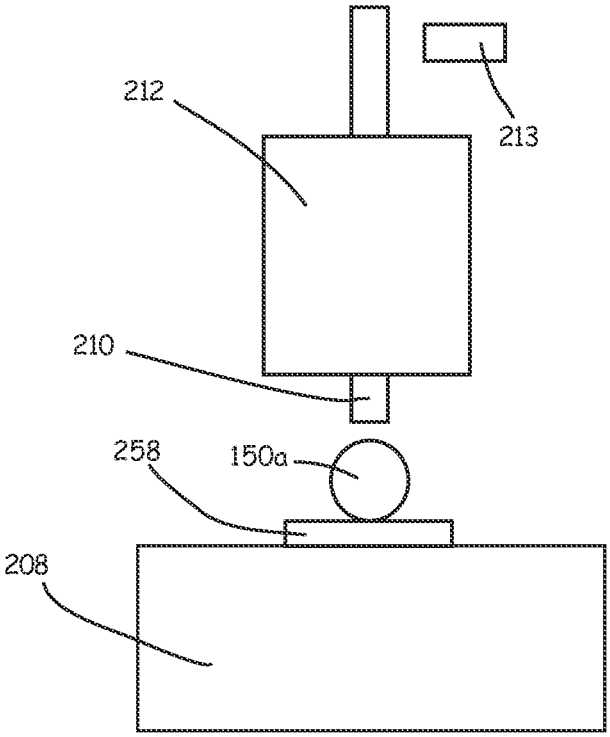
FIG. 3A shows part of the second apparatus of FIG. 2, including a pressure pre-test station, a stroke shaft, a tennis ball, a pre-test force sensing resistor, and a work station turntable, wherein the stroke shaft is in a state where it extends upwards a first amount, and is not contacting the tennis ball, in accordance with an embodiment of the present invention.

FIG. 3A shows part of the second apparatus of FIG. 2, including a pressure pre-test station assembly 212, the stroke shaft 210, the tennis ball 150*a*, the pre-test force sensing resistor 258, and the work station turntable 208, wherein the stroke shaft 210 is in a state where it extends upwards a first amount, and is not contacting the tennis ball 150*a*, in accordance with an embodiment of the present invention.

Figure 3B:
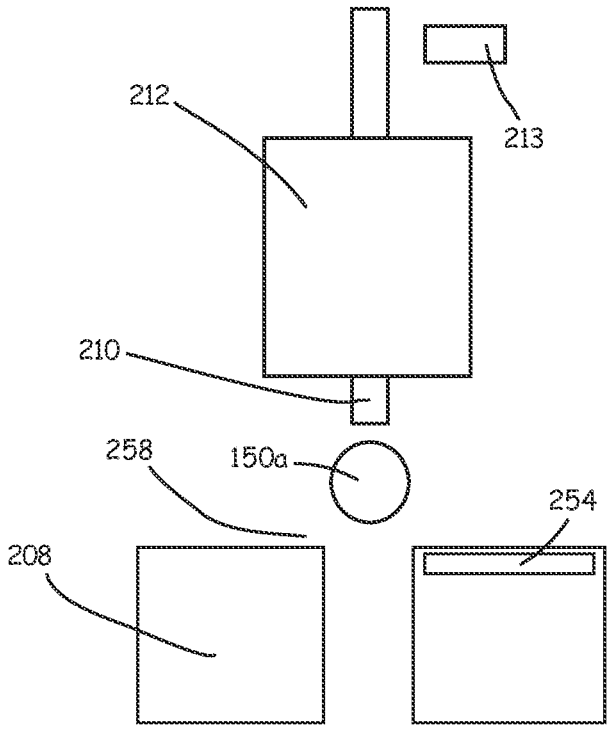
FIG. 3B shows part of the second apparatus of FIG. 2, including a pressurization station, a stroke shaft, a tennis ball, and a work station turntable, wherein the stroke shaft is in a state where it extends upwards a first amount, and is not contacting the tennis ball, in accordance with an embodiment of the present invention.

FIG. 3B shows part of the second apparatus of FIG. 2, including the pressurization re-test station assembly 212, the stroke shaft 210, a tennis ball 150*a*, and the work station turntable 208, wherein the stroke shaft 210 is in a state where it extends upwards a first amount, and is not contacting the tennis ball 150*a*, in accordance with an embodiment of the present invention.

Figure 4A:
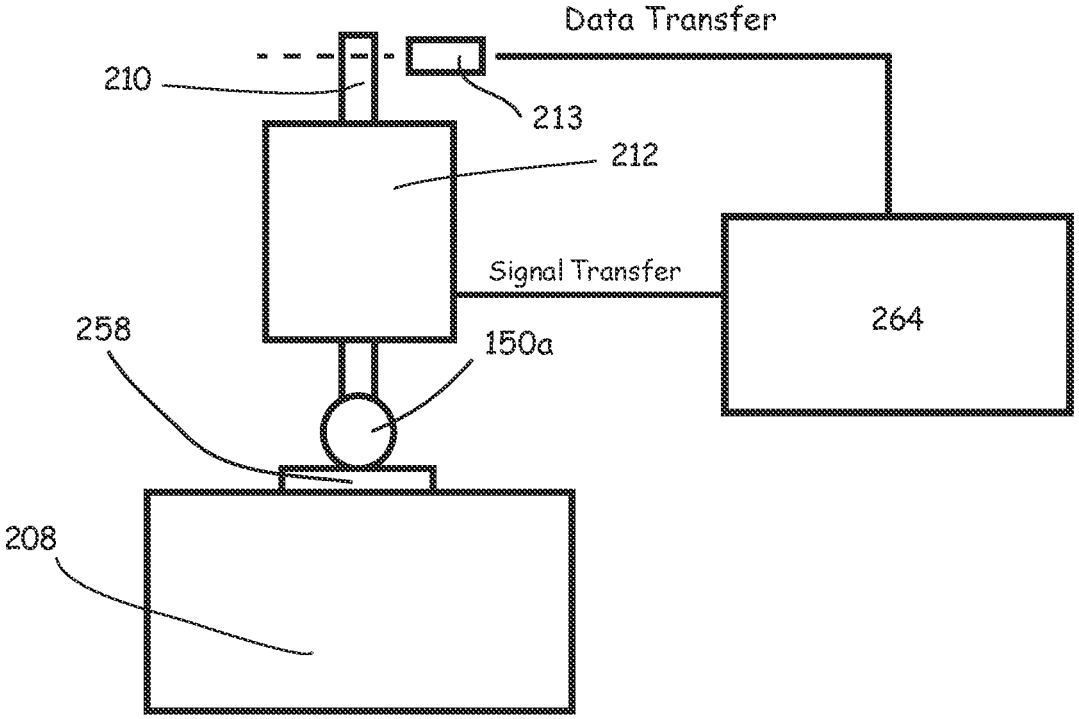
FIG. 4A shows part of the second apparatus of FIG. 2 including the stroke shaft, the pressure pre-test station, the pre-test force sensing resistor, and the work station turntable, wherein the stroke shaft is in a state where it extends downwards a second amount.

FIG. 4A shows part of the second apparatus of FIG. 2 including the computer processor control circuit 264, the stroke shaft 210, the pressure pre-test assembly 212, the new tennis ball 150*a*, the pre-test force sensing resistor 258, and the work station turntable 208, wherein the stroke shaft 210 is in a state where it is contacting the tennis ball 150*a*; and the pressure pre-test assembly 212 conducts multiple tests in the state of FIG. 4A on new balls to allow the pre-test force sensing resistor 258 to collect average pressure data.

Figure 4B:
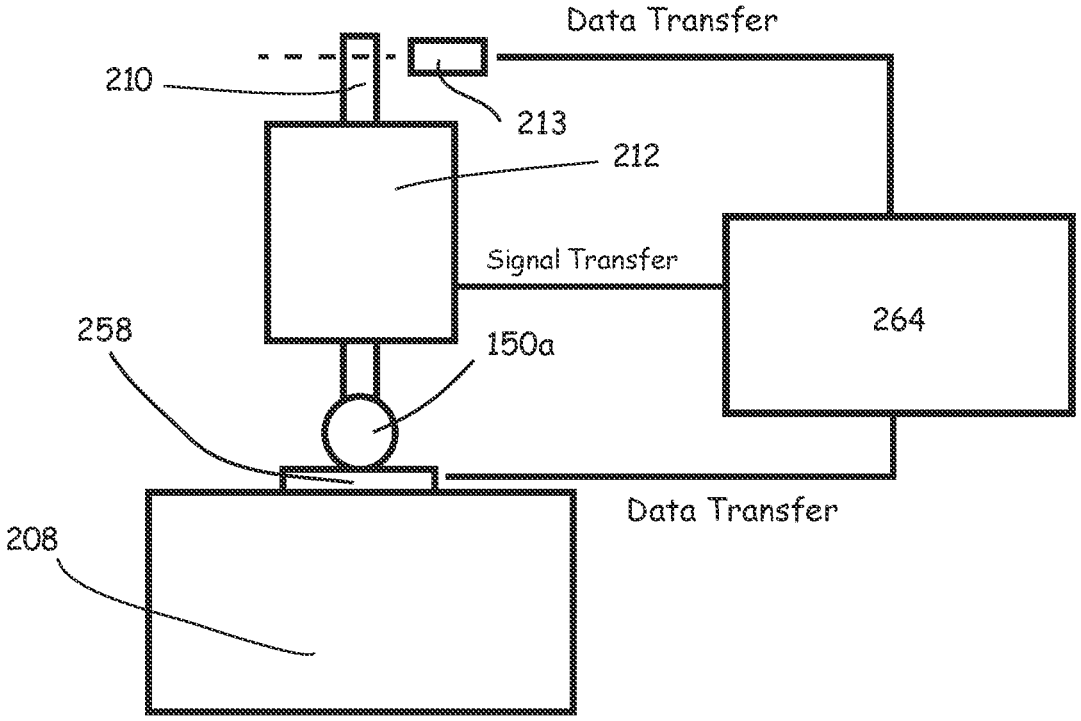
FIG. 4B shows part of the second apparatus of FIG. 2 including a computer processor control circuit, the stroke shaft, the pressure pre-test station, the tennis ball, the pre-test force sensing resistor, and the work station turntable, wherein the stroke shaft is in a state where it is contacting the tennis ball; and the pressure pre-test station conducts multiple tests in the state of FIG. 4A on new balls to allow the pre-test force sensing resistor to collect average pressure data.

FIG. 4B shows part of the second apparatus of FIG. 2 including the stroke shaft 210, the pressure pre-test assembly 212, the pre-test force sensing resistor 258, and the work station turntable 208, wherein the stroke shaft 210 is in a state where it extends downwards a second amount.

The computer processor control circuit 264 causes a plurality of tests of each out of can new balls, such as new ball 150*a*, to be conducted by use of pressure pre-test station 212 to allow pre-test force sensing resistor 258 to collect a single item of pressure data and then supply that to the computer processor control circuit 264. The circuit 264 typically includes computer memory for storing the single item of pressure data. Each pressure test is conducted by repeating the new balls pressure test by placing new balls on the FSR or pre-test resistor 258 and repeating the stroke shaft 210 upward and downward position; and each item of pressure data is stored in the circuit 264, and then averaged pressure data is determined for each ball, such as ball 150*a*, typically average new ball pressure is 75.0 psi (pounds per square inch). For each test, the stroke shaft 210 presses against the ball 150*a* and the force sensing resistor 258 determines how much force is transmitted through the ball 150*a*, and through other balls of plurality of balls 150, wherein each ball of 150 is tested one at a time, and each ball of 150 is tested multiple times.

The data from the pre-test force sensing resistor 258 is sent to the computer control circuit 264 to allow the sensor 213 to set an exact or fixed position for the stroke shaft 210 for the next pressure test. This should complete the apparatus calibration. The calibration is usually conducted and preset at factory before delivering to franchisees.

Typically, by default the stroke shaft 210 will always be in an extract position, wherein the shaft 210 is upward to allow the ball 150*a* to be in the station or on the FSR resistor 258 as shown in FIG. 3A, to cause the ball 150*a* to be in the ball processing slot 204 and the ball processing slot 204 will only be closed when the approach sensor 256 on the work station turntable 208 detects an incoming new ball of the plurality of balls 150.

Figure 5A:
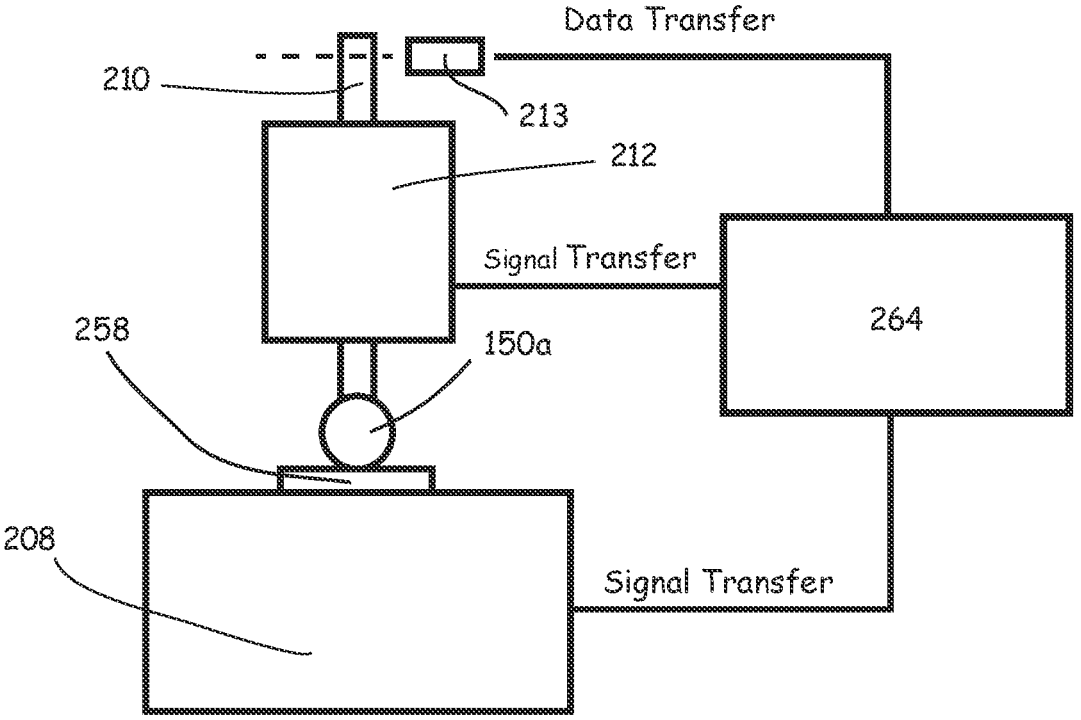
FIG. 5A shows part of the second apparatus of FIG. 2 including the computer processor control circuit, the stroke shaft, the pressure pre-test station, the tennis ball, the pre-test force sensing resistor, and the work station turntable, wherein the stroke shaft is in a state where it is contacting the tennis ball for a deflated test.

FIG. 5A shows part of the second apparatus of FIG. 2 including the computer processor control circuit 264, the stroke shaft 210, the pressure pre-test assembly 212, the tennis ball 150*a*, the pre-test force sensing resistor 258, and the work station turntable 208, wherein the stroke shaft 210 is in a state where it is contacting the tennis ball 150*a* for a deflated test.

Figure 5B:
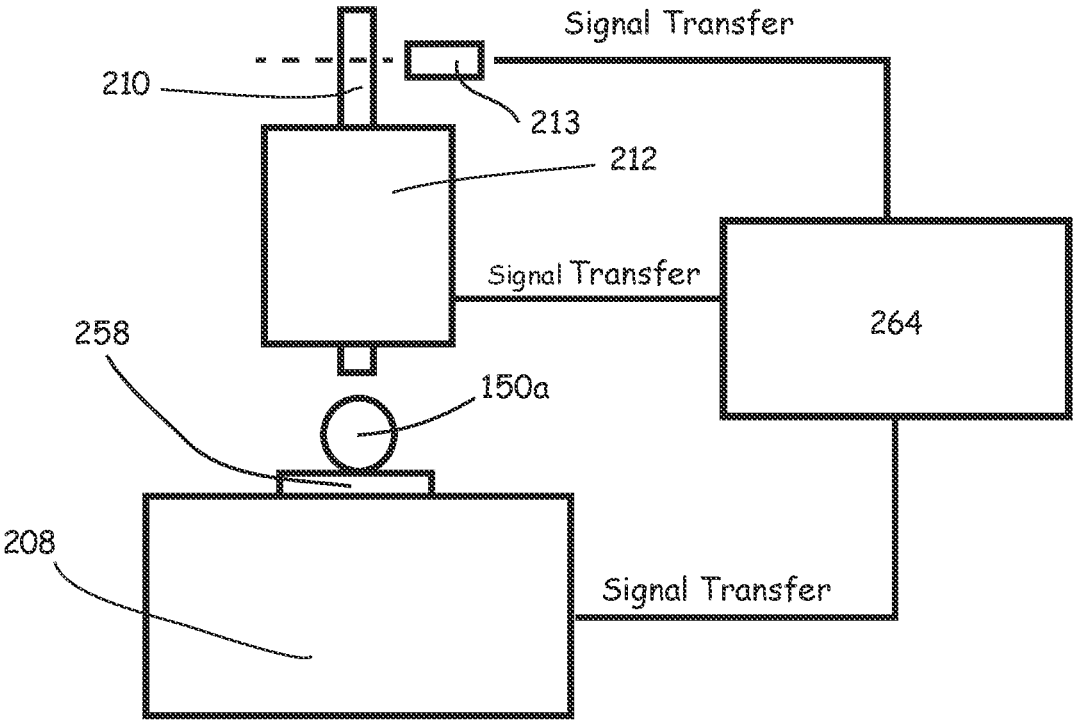
FIG. 5B shows part of the second apparatus of FIG. 2 including the computer processor control circuit, the stroke shaft, the pressure pre-test station, the pre-test force sensing resistor, and the work station turntable, wherein the stroke shaft is in a state where it extends upwards to release the ball from the pre-test station.

FIG. 5B shows part of the second apparatus of FIG. 2 including the computer processor control circuit 264, the stroke shaft 210, the pressure pre-test assembly 212, the pre-test force sensing resistor 258, and the work station turntable 208, wherein the stroke shaft 210 is in a state where it extends downwards to allow the ball 150*a* to move onward from pre-test station to pressurization station.

For the deflated test, the ball 150*a* falls into the ball processing slot 204 to be tested. The computer processor control circuit 264 causes the stroke shaft and/or shaft 210 to extend its position to allow the pre-test force sensing resistor 258 to collect data for the deflated ball, wherein deflated may mean a tennis ball having 60.0 psi (pounds per square inch) of pressure. The pre-test force sensing resistor 258 provides data to the computer processor control circuit 264 that indicates that the ball 150*a* needs 15.0 psi (pounds per square inch) of pressure more, i.e. needs more air. Typically, a new tennis ball has 75.0 psi of pressure while a deflated ball may have 60.0 psi of pressure or less. A margin of error of plus or minus two percent of the 15.0 psi of added pressure to the deflated ball may be permitted.

The computer processor control circuit 264 may then cause the stroke shaft or shaft 210 to move upwards away from the ball 150*a* to allow the ball 150*a* to move onward for pressurization stages of one or more of FIGS. 8-13.

Figure 6A:
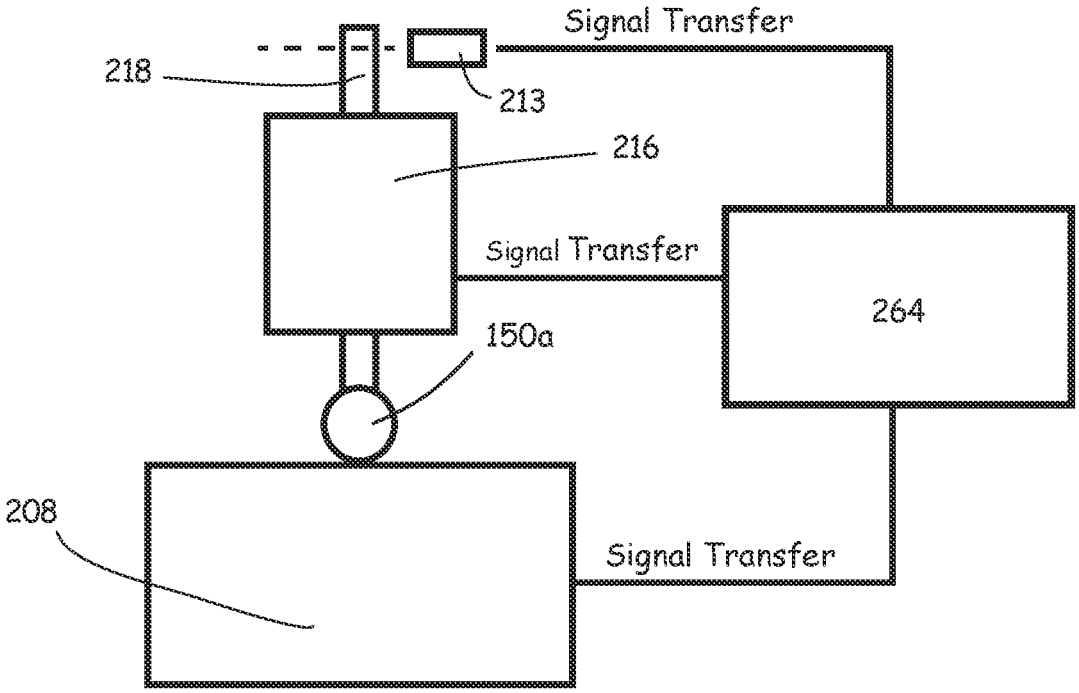
FIG. 6A shows part of the second apparatus of FIG. 2 including the computer processor control circuit, the stroke shaft, the pressurization station, the tennis ball, and the work station turntable, wherein the stroke shaft is in a state where it is contacting the tennis ball for deflated pressurization.

FIG. 6A shows part of the second apparatus of FIG. 2 including the computer processor control circuit 264, the stroke shaft 218, the positioner assembly 216, the tennis ball 150*a*, and the work station turntable 208, wherein the stroke shaft 210 is in a state where it is contacting the tennis ball 150*a* for deflated ball pressurization.

Figure 6B:
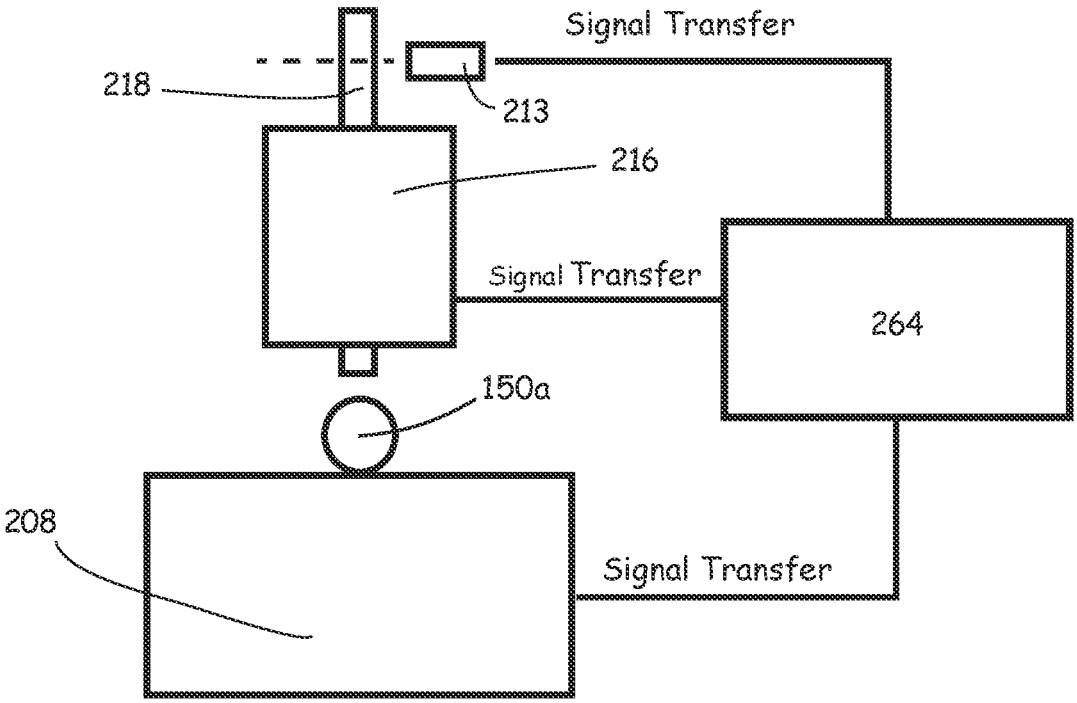
FIG. 6B shows part of the second apparatus of FIG. 2 including the computer processor control circuit, the stroke shaft, the pressurization station, and the work station turntable, wherein the stroke shaft is in a state where it extends upwards to release the ball from the pressurization station.

FIG. 6B shows part of the second apparatus of FIG. 2 including the computer processor control circuit 264, the positioner shaft 218, the positioner assembly 216, and the work station turntable 208, wherein the stroke shaft 210 is in a state where it extends upwards to allow ball move to the re-test station.

The deflated ball 150*a* is sent to pressurization in or by positioner assembly 216 via work station turntable 208. With the positioner shaft 218 set an exact position, air is injected into the 150*a*, to add 15.0 psi worth of air pressure to the inner chamber of the ball 150*a*. The computer processor control circuit 264 controls the solenoid valve 242 to cause the solenoid valve 242 to provide the amount of air needed to reach 15.0 psi of air pressure within the ball 150*a*. The control circuit 264 causes the solenoid valve 242 to stop adding to the air pressure of the ball 150*a* when the processor control circuit 264 senses that the stroke shaft 218 has reached a particular exact position or X position. The positioner assembly 216 extracts the ball 150*a*, after 15.0 psi of air pressure have been reached for the ball 150*a*, to allow the ball 150*a* to move onward for re-Testing.

Figure 7A:
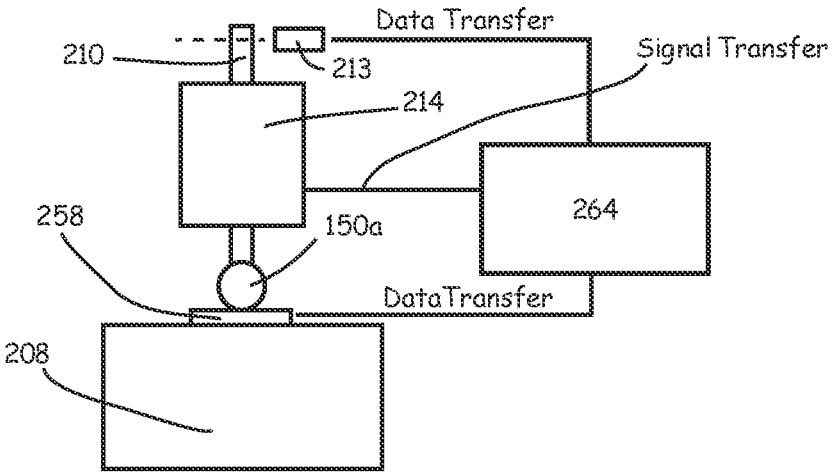
FIG. 7A shows part of the second apparatus of FIG. 2 including the computer processor control circuit, the stroke shaft, the pressure re-test station, the tennis ball, the re-test force sensing resistor, and the work station turntable, wherein the stroke shaft is in a state where it is contacting the tennis ball, for retesting.

FIG. 7A shows part of the second apparatus of FIG. 2 including the computer processor control circuit 264, the stroke shaft 210, the pressure re-test station assembly 214, the tennis ball 150*a*, the re-test force sensing resistor 258, and the work station turntable 208, wherein the stroke shaft 210 is in a state where it is contacting the tennis ball, for retesting.

Figure 7B:
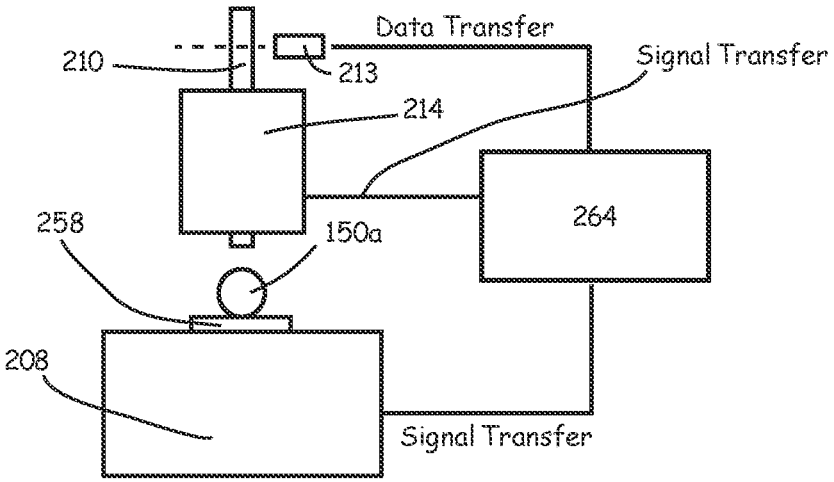
FIG. 7B shows part of the second apparatus of FIG. 2 including the computer processor control circuit, the stroke shaft, the pressure pre-test station, the re-test force sensing resistor, and the work station turntable, wherein the stroke shaft is in a state where it extends upwards to release the ball from the pre-test station.

FIG. 7B shows part of the second apparatus of FIG. 2 including the computer processor control circuit 264, the stroke shaft 210, the pressure re-test station 214, the re-test force sensing resistor 258, and the work station turntable 208, wherein the stroke shaft 210 is in a state where it extends upwards for releasing the ball.

Figure 7C:
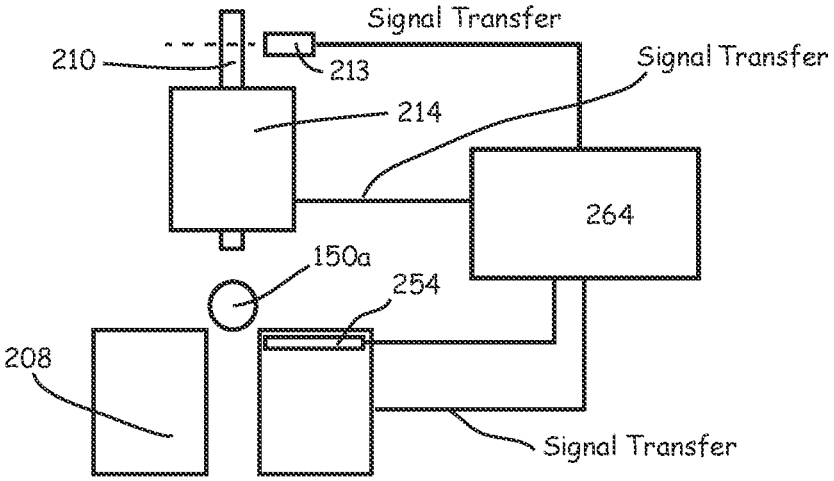
FIG. 7C shows part of the second apparatus of FIG. 2 including the computer processor control circuit, the stroke shaft, the pressure re-test station, the work station turntable, and the ball dispenser open/close control wherein the stroke shaft is in a state where it extracts and/or extends upward the second amount, and the ball is about to be dispensed when it is opened or closed for the ball to be retested in FIG. 5A.

FIG. 7C shows part of the second apparatus of FIG. 2 including the computer processor control circuit 264, the stroke shaft 210, the pressure re-test station 214, the work station turntable 208, and the ball dispenser open/close control 254 wherein the stroke shaft 210 is in a state where it extends upwards and the ball 150*a* is about to be dispensed or for retesting.

The pressurized ball 150*a* is sent to retest, as shown by FIGS. 7A-C. Anything below allowable 75.0 psi of air pressure) for the ball 150*a* will not be released by computer processor and/or control circuit 164 keeping ball dispenser open/close control 254 closed. If the ball 150*a* fails the retest, the ball will be sent over for another round of pressurization (FIGS. 8-13) before the set range is reached and the ball 150*a* is released through the ball dispenser 232. The ball 150*a* will be released through ball dispenser 232 if it's a pass. By default, ball dispenser open/close control 254 is set to open to allow ball 150*a* to be released.

Figure 8:
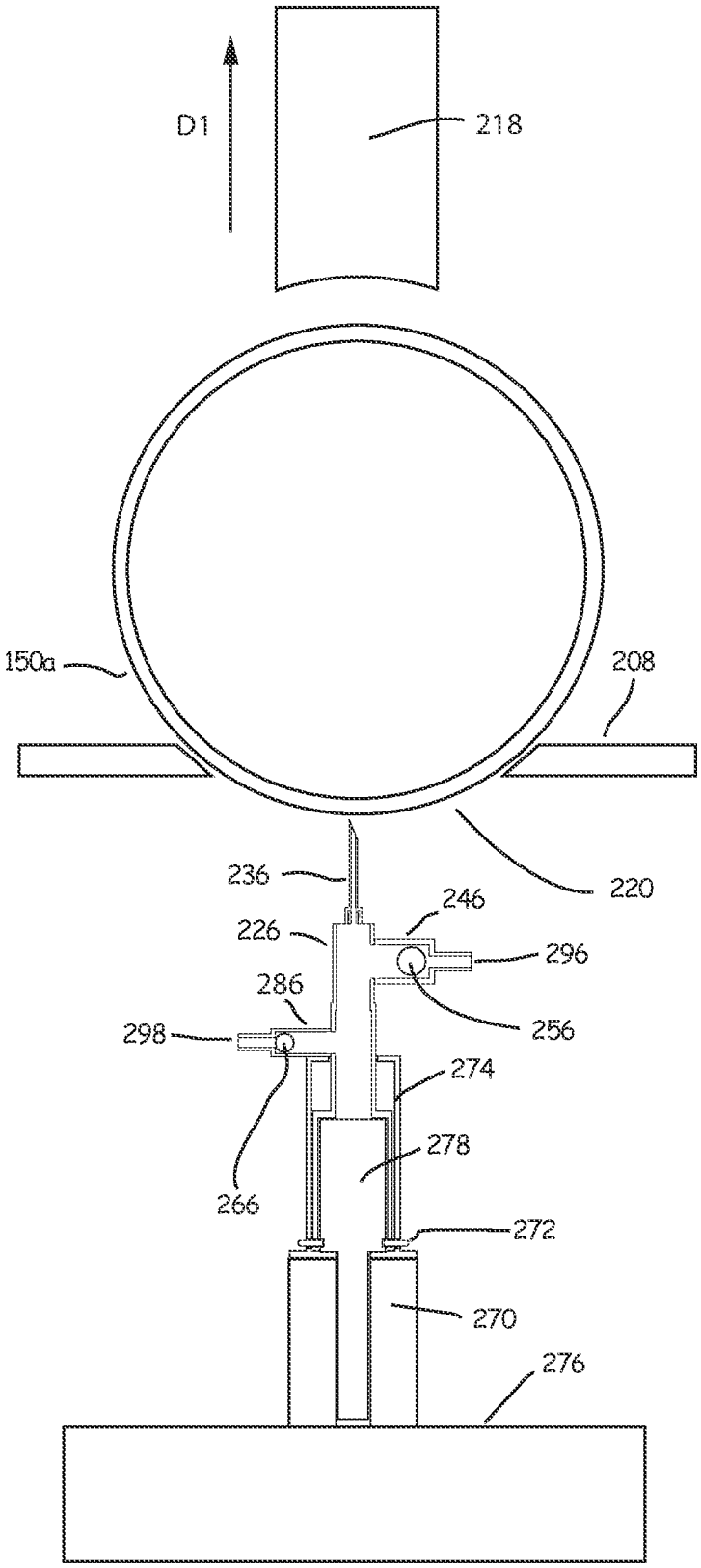
FIG. 8 shows part of the second apparatus of FIG. 2, including a second stroke shaft, the ball, the work station turntable, a ball processing slot, a needle entrance, a photoelectric switch sensor and a pressurization assembly in a first state wherein the second stroke shaft is above and not in contact with the ball for the computer processor control circuit sending a signal from where to activate a solenoid valve to allow the second stroke shaft to extend to hold the ball in a ball processing slot.

FIG. 8 shows part of the second apparatus of FIG. 2, including a second stroke shaft 218, the ball 150*a*, the work station turntable 208, a ball processing slot 220, a needle 236, a tubing shaft 226, a sealant anti-backflow system 286 with a bearing control 266, an air anti-backflow system 246 with a bearing control 256, and a pressurization assembly 270 in a first state wherein the second stroke shaft 218 is above and not in contact with the ball 150*a* for the computer processor control circuit 264 sending a signal from where to activate the solenoid valve 244 to allow the second stroke shaft 218 to extend to hold the ball 150*a* in the ball processing slot 220. In FIG. 8, D1 identifies a line with an arrow, identifying an upward direction. Both of the bearing control 266 in the sealant anti-backflow system 286 and the bearing control 256 in the air anti-backflow system 246 are in close positions.

Figure 9:
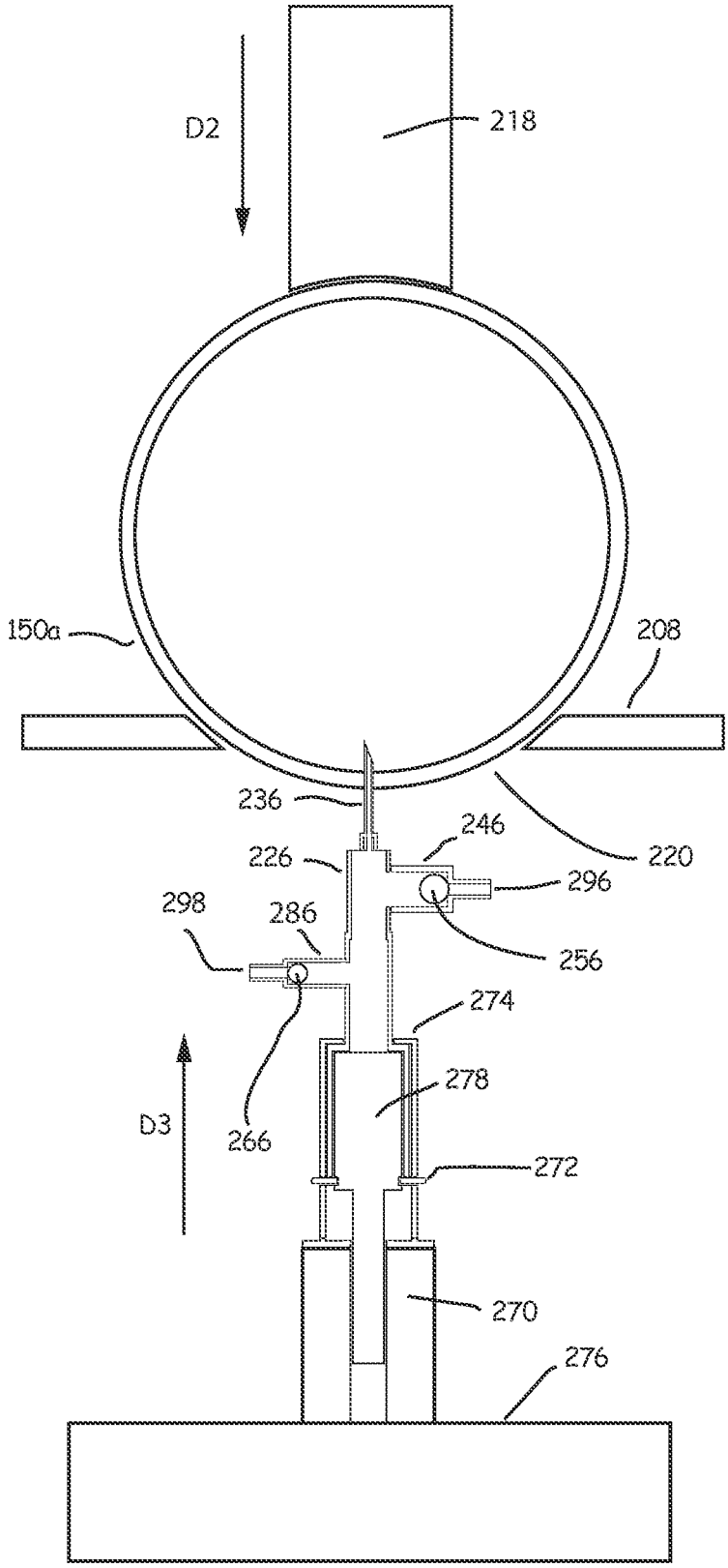
FIG. 9 shows the components of FIG. 8, wherein as the photoelectric switch sensor detects the ball, the second stroke shaft has been lowered so that it now is pressing and holding the ball in position for the computer processor control circuit to send a signal to activate a solenoid valve to cause the pressurization assembly stroke to extend and the needle to pierce the ball.

FIG. 9 shows the components of FIG. 8, wherein the second stroke shaft 218 has been lowered so that it now is closer to the ball 150*a* and the needle 236 is now piercing the ball 150*a*, for the computer processor control circuit 264 sending a signal to activate the solenoid valve 240 to allow the tubing shaft 226 to extend. In FIG. 9, D2 identifies a line with an arrow, identifying a downward direction; and D3 identifies a line with an arrow, identifying an upward direction.

Figure 10:
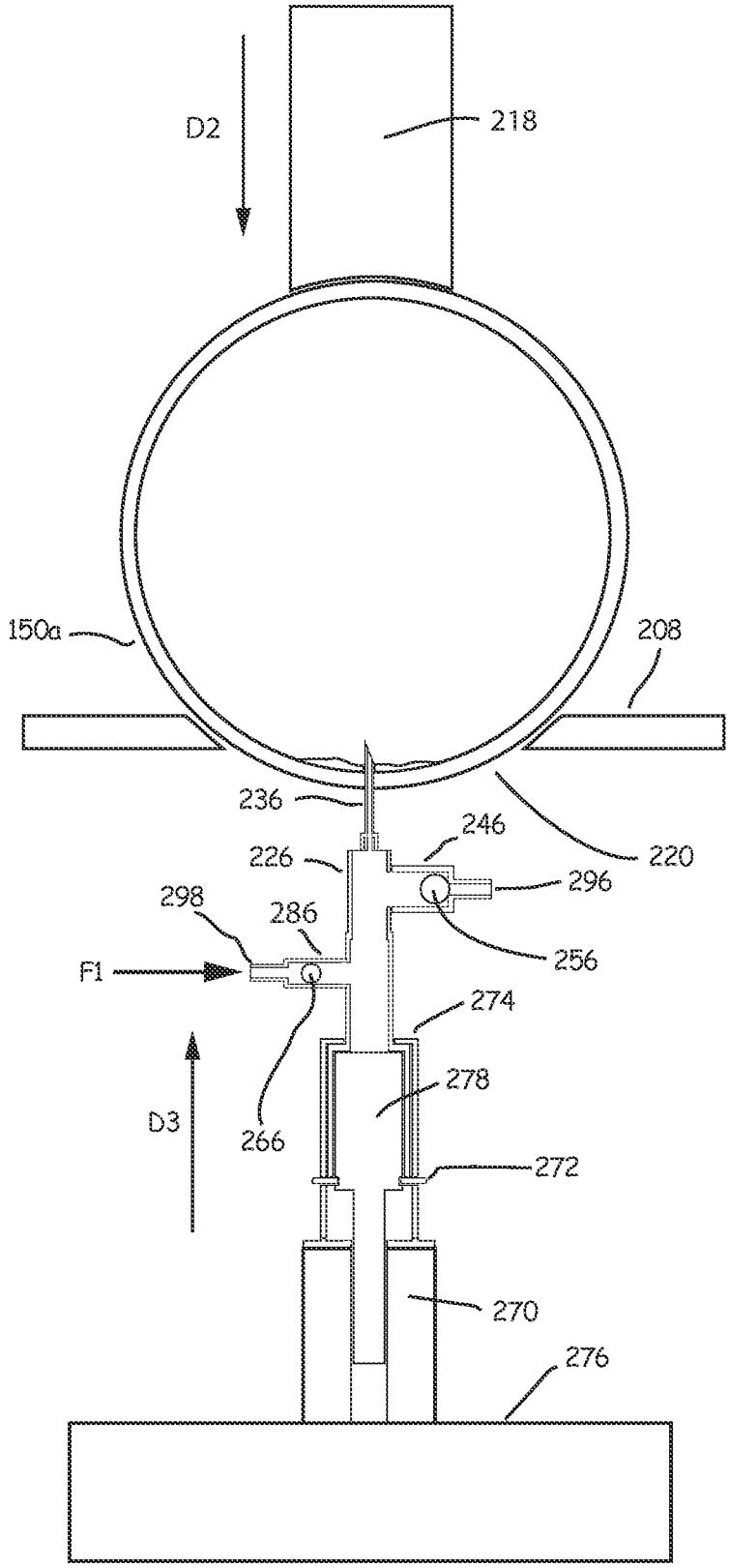
FIG. 10 shows the components of FIG. 8, wherein the computer processor control circuit is sending a signal to activate a solenoid valve to cause a sealant pump to pump sealant from a sealant container into the pressurization assembly, and sealant is injected into the inner chamber of the ball through the needle.

FIG. 10 shows the components of FIG. 8, wherein the needle 236 has not supplied air to the inside of the ball 150*a* for the computer processor control circuit 264 sending a signal to activate a solenoid valve 238 to cause sealant pump 230 to pump sealant from a sealant container into the pressurization assembly 270, and sealant is injected into the inner chamber of the ball 150*a* through the needle 236. When sealant is pumped in the tubing 266 through the sealant entrance 298 (F1), the sealant anti-backflow system 286 with a bearing control 266 is opened to allow sealant into the tubing 226. The bearing control 256 in the air anti-backflow system 246 is pushed against the air entrance 296 and by both the internal pressure of the sealant and a spring system installed in it. As a result, sealant is stopped from flowing into the air entrance 296. In FIG. 10, D2 identifies a line with an arrow, identifying a downward direction; D3 identifies a line with an arrow, identifying an upward direction; and F1 identifies a line with an arrow, identifying a force and/or direction from the left to the right.

Figure 11:
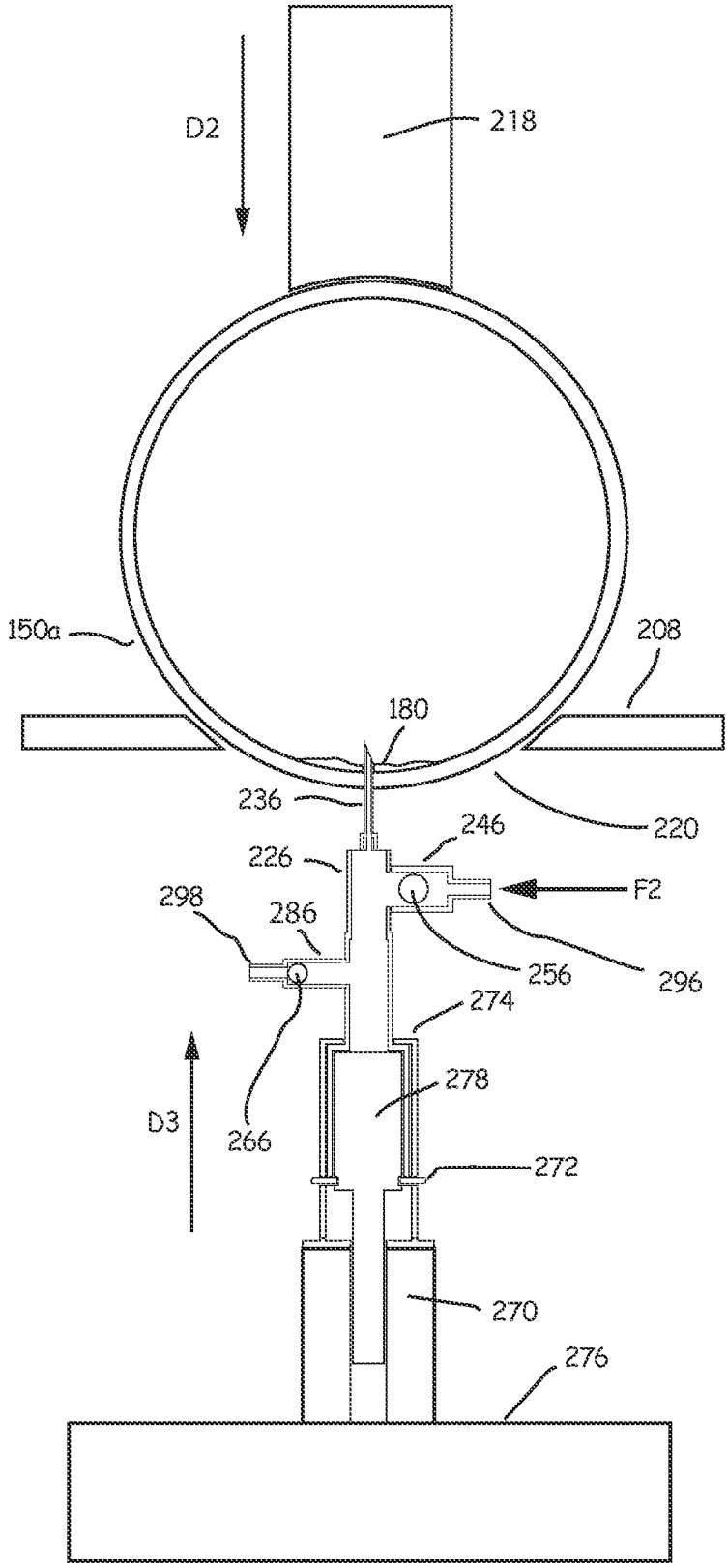
FIG. 11 shows the components of FIG. 8 wherein the computer processor control circuit sends a signal to activate a solenoid valve to cause air to be pumped into the inner chamber of the ball.

FIG. 11 shows the components of FIG. 8 wherein the computer processor and/or control circuit 264 sends a signal to activate the solenoid valve 242 to cause air to be pumped into the inner chamber of the ball 150*a*. In FIG. 11, D2 identifies a line with an arrow, identifying a downward direction; D3 identifies a line with an arrow, identifying an upward direction; and F2 identifies a line with an arrow, identifying a force and/or direction from the right to the left. When air is pumped in the tubing 266 through the air entrance 296 (F2), the air anti-backflow system 246 with a bearing control 256 is opened to allow air into the tubing 226. The bearing control 266 in the sealant anti-backflow system 286 is pushed against the sealant entrance 298 by both the internal pressure of the air and a spring system installed in it. As a result, air is stopped from flowing into the sealant entrance 298.

Figure 12:
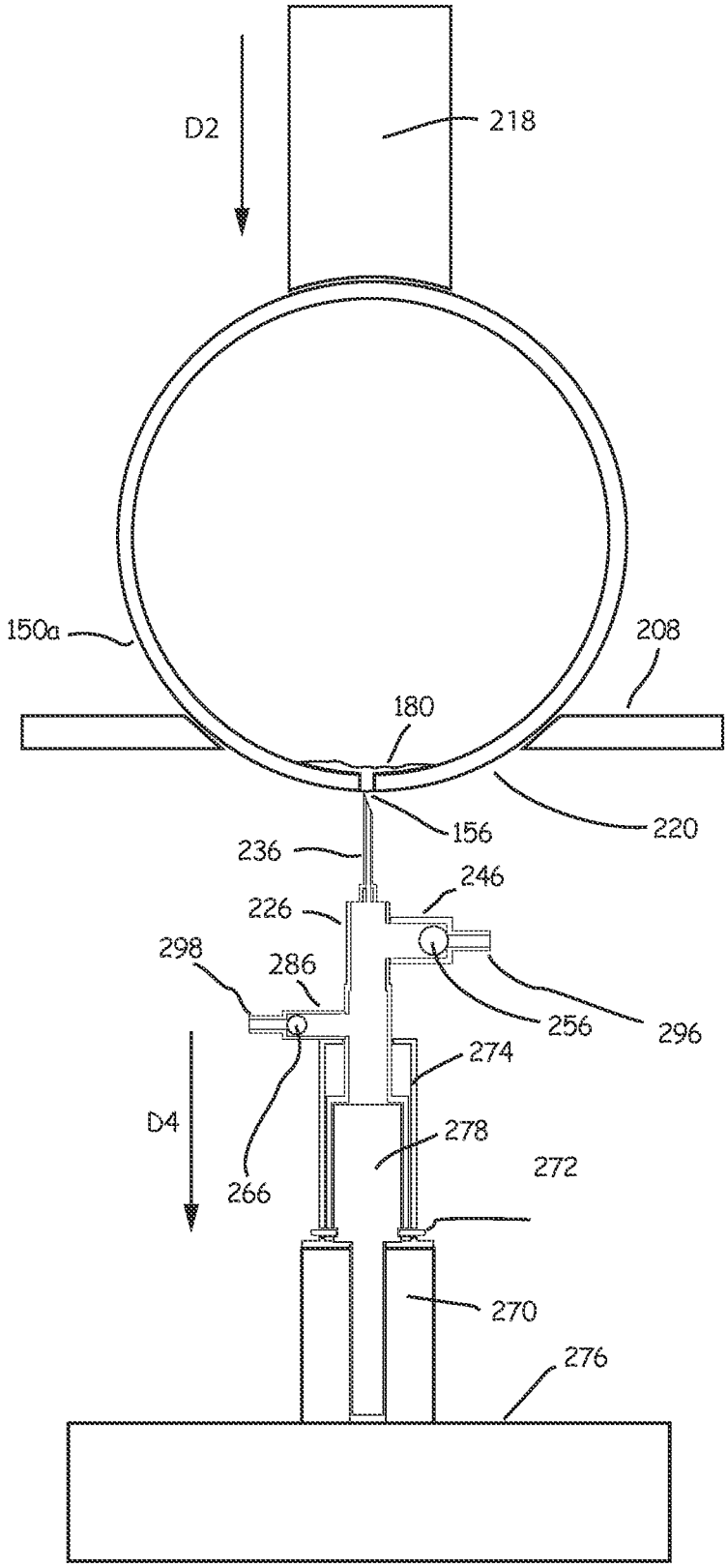
FIG. 12 shows the components of FIG. 8 wherein the needle has been taken out from its entrance and leaving a hole of the size of the diameter of the needle in the covering or skin of the ball, wherein the computer processor control circuit sends a signal to activate a solenoid valve to cause the pressurization assembly stroke to extract the needle from the inner chamber of the ball, the hole is sealed by the air pressure inside of the ball pushing the sealant towards the hole as the needle exits the ball.

FIG. 12 shows the components of FIG. 8 wherein the needle 236 has been taken out leaving a hole in the ball 150*a*, wherein the computer processor and/or control circuit 264 sends a signal to activate the solenoid valve 240 to cause the tubing shaft 226 to extract the needle 236 from the inner chamber of the ball 150*a*. In FIG. 12, D2 identifies a line with an arrow, identifying a downward direction; and D4 identifies a line with an arrow, identifying a downward direction. Both sealant anti-backflow system 286 and air anti-backflow systems 246 mechanism were closed by their respect spring systems to prevent the backflow of sealant and air.

Figure 13:
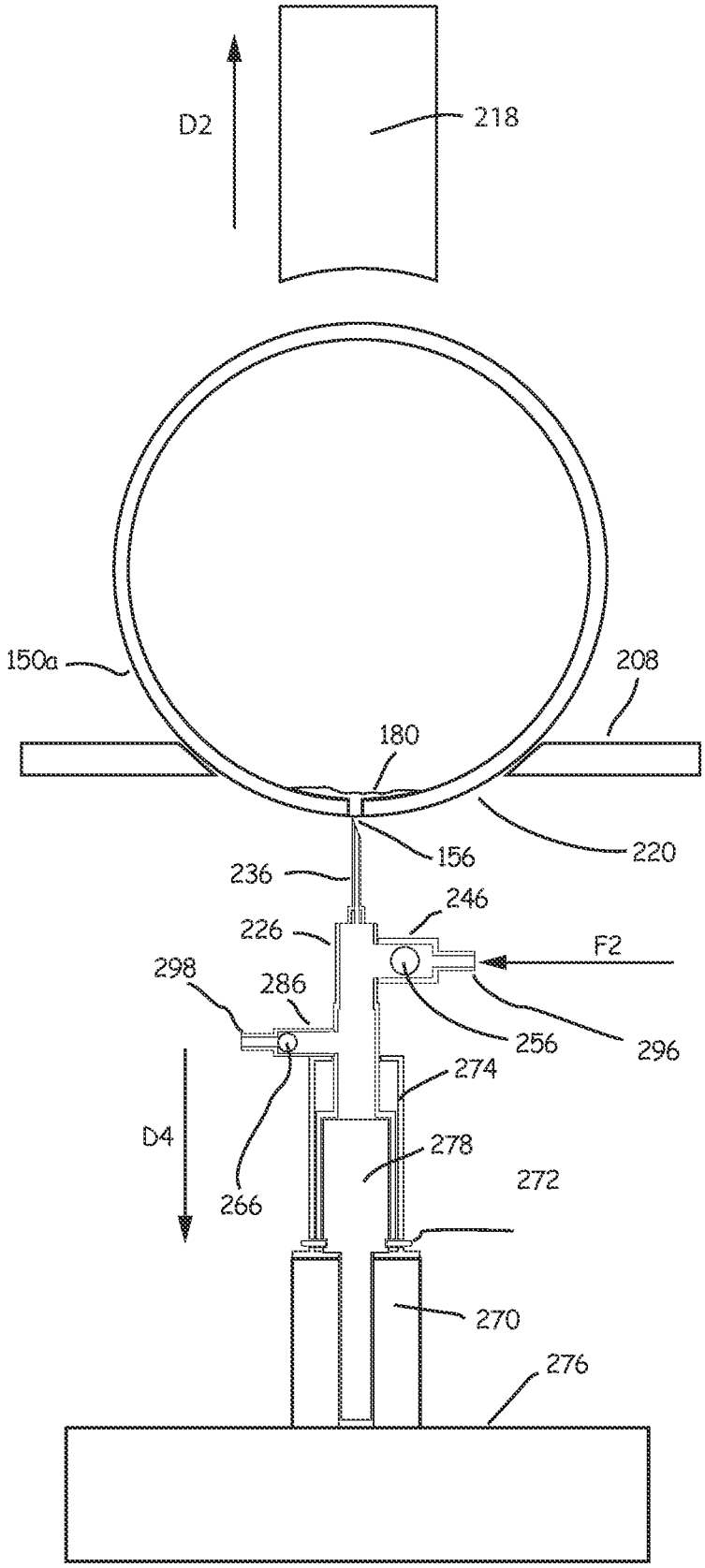
FIG. 13 shows the components of FIG. 8 wherein the computer processor control circuit sends a signal to activate a solenoid valve to cause air to blow on the surface of the ball and thus to seal the sealant on the pinned area or hole caused by insertion of the needle in FIG. 9; and the computer processor control circuit then sends out a signal to activate a solenoid valve to cause the second stroke shaft to be raised from the state of FIG. 12.

FIG. 13 shows the components of FIG. 8 wherein the computer processor control circuit 264 sends a signal to activate a solenoid valve 242 to allow are to blow on the surface of the ball thus to seal the pinned area or hole caused by insertion of the needle 236 in FIG. 9, wherein the air blowing serves two functions: (1) dries up the surface area of the pinned area and (2) cleans up any blockage inside of the needle 236 for the next round of pressurization; and the computer processor control circuit 264 then sends out a signal to activate the solenoid valve 244 to cause the second stroke shaft 218 to be raised from the state of FIG. 12. In FIG. 13, D2 identifies a line with an arrow, identifying an upward direction; and U2 identifies a line with an arrow, identifying a downward direction. In FIG. 13, D1 identifies a line with an arrow, identifying a upward direction; D4 identifies a line with an arrow, identifying a downward direction; and F2 identifies a force and/or direction from right to left, which may be the same and/or similar to as in FIG. 11. When air is pumped in the tubing 266 through the air entrance 296 (F2), the air anti-backflow system 246 with a bearing control 256 is opened to allow air into the tubing 226. The bearing control 266 in the sealant anti-backflow system 286 is pushed against the sealant entrance 298 by both the internal pressure of the air and a spring system installed in it. As a result, air is stopped from flowing into the sealant entrance 298.

FIG. 14 is a flow chart 300 of a first method, which includes a calibration process 302, deflated ball pre-test process 304, deflated ball pressurization process 306, and pressurized ball retesting process 308 in accordance with an embodiment of the present invention.

The calibration process 302 includes multiple steps or sub steps and is shown at least in part, by FIGS. 4A-4B. The calibration process 302 begins with (1) station 211 conducting multiple tests on each ball of new balls 105 to allow FSR 258 which is affixed on the base plate 235 to collect average new ball pressure data (e.g. 75.0 psi). The calibration process 302 continues with (2) the FSR 258 sending data to PLC 264 to allow sensor 213 to set an exact or fixed position of the positioner shaft 210 (e.g. Position X). Next at (3) the Calibration is now completed and the new ball is removed from ball slot 204 which is aligned with the FSR 258. At substep (4) of the process 302, by default, the shaft 210 is in an extract upward position to allow turntable 222 to rotate to move ball to the pressurization station 223 after station 211 finishes its job. The shaft 210 extends downward and hold the ball 150*a* in position when sensor 256 detects a ball 150*a* in the ball slot 204.

The deflated ball pre-test process 304 of FIG. 14, includes multiple steps or sub steps and is shown at least in part by FIGS. 5A-5B. The deflated ball pre-test process 304 begins with (1) the ball feeder 102 releases a deflated ball 105*a* into the ball Slot 204. The sensor 256 detects the ball and sends out a signal to PLC 264 to allow turntable 222 to turn, bringing the deflated ball 150*a* to the station 211 to be tested. The deflated ball pre-test process 304 continues with (2) the positioner shaft 210 extending downward to preset position X to allow the FSR 258 to collect data of the deflated ball (e.g. 60.0 psi) and send the data to PLC 264 which process the data and sends a signal to station 211 to allow the ball 150*a* to have 15.0 psi of air pressure added (new ball 75.0 psi-deflated ball 60.0 psi). A margin of +2% or −2%, is allowed. At sub step (3) upon completion of the pretest, positioner shaft 210 extracts upward to allow the ball 150*a* to move onward to the pressurization station 223 for pressurization.

The deflated ball pressurization process 306 includes multiple steps or sub steps and is shown at least in part, by FIGS. 6A-6B. The deflated ball pressurization process 306 begins with (1) the deflated ball 150*a* is detected by sensor 224 and is positioned on ball slot 220, (wherein 220 is a continuation of 204) by positioner shaft 218 to get pressurized as indicated in the pressurization procedure shown by FIGS. 8-13. The process 306 continues at (2) where as soon as pressurization is completed, 15.0 psi of air is injected into the ball and positioner shaft 218 reached the position X which is detected by the sensor 217. The sensor 217 sends a signal to PLC 264 to cause the positioner shaft 210 to be extracted upwards to allow the ball 150*a* to move on to retesting station shown by FIG. 7A through FIG. 7C for retesting.

The pressurized ball retesting process 308 includes multiple steps or sub steps and is shown at least in part, by FIGS. 7A, 7B, and 7C. The pressurized ball retesting process 308 begins with (1) pressurized ball 150*a* is brought to retesting station 262 by turntable 222. Then (2) the positioner shaft 219 is extended downward to position the ball 150*a* in the ball slot 220 to allow sensor 237 to collect data which is sent to PLC 264 for analyzing and processing. Next at (3) the PLC 264 analyses (in accordance with a computer program stored in its computer memory) and gives a signal to turntable 222 to rotate. The PLC 264 also gives a signal to the ball dispenser open/close valve 254 to close to not allow the ball to be released through the ball exit 232 if the data is below a set range as set in the new ball calibration in process 302. The failed ball will be sent over another round of pre-test process 304, pressurization process 306 and re-testing process 308 before it reaches the set Range as set in the new ball calibration process 302 as a pass. At (4) of the process 308, by default the ball dispenser open/close valve is opened to allow ball to exit.

Figure 15A:
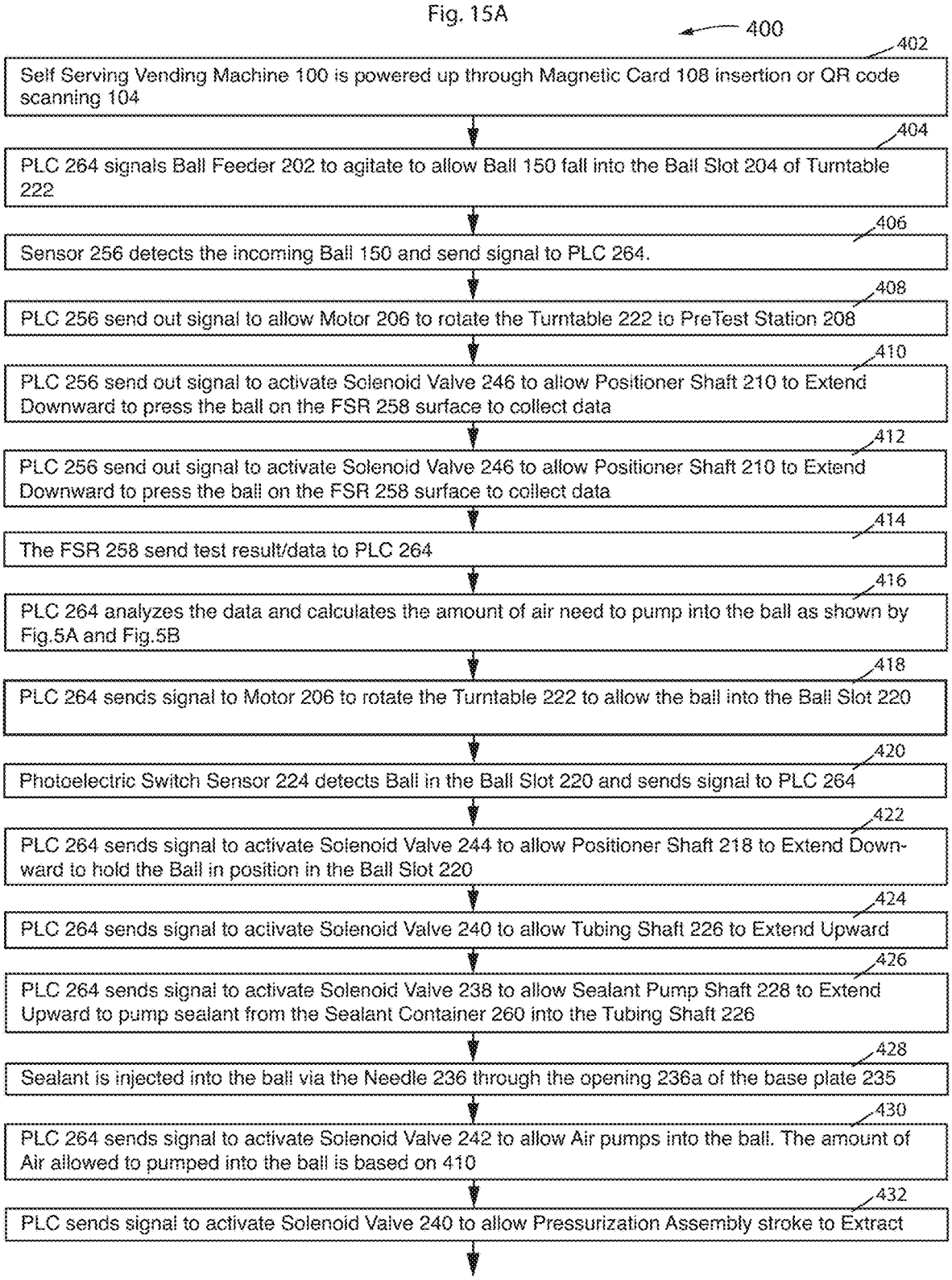
FIGS. 15A-15B shows a flow chart of a second method, which includes a multiple step process for a procedural cycle from activation of the overall apparatus or machine to data collection of the cloud system.
Figure 15B:
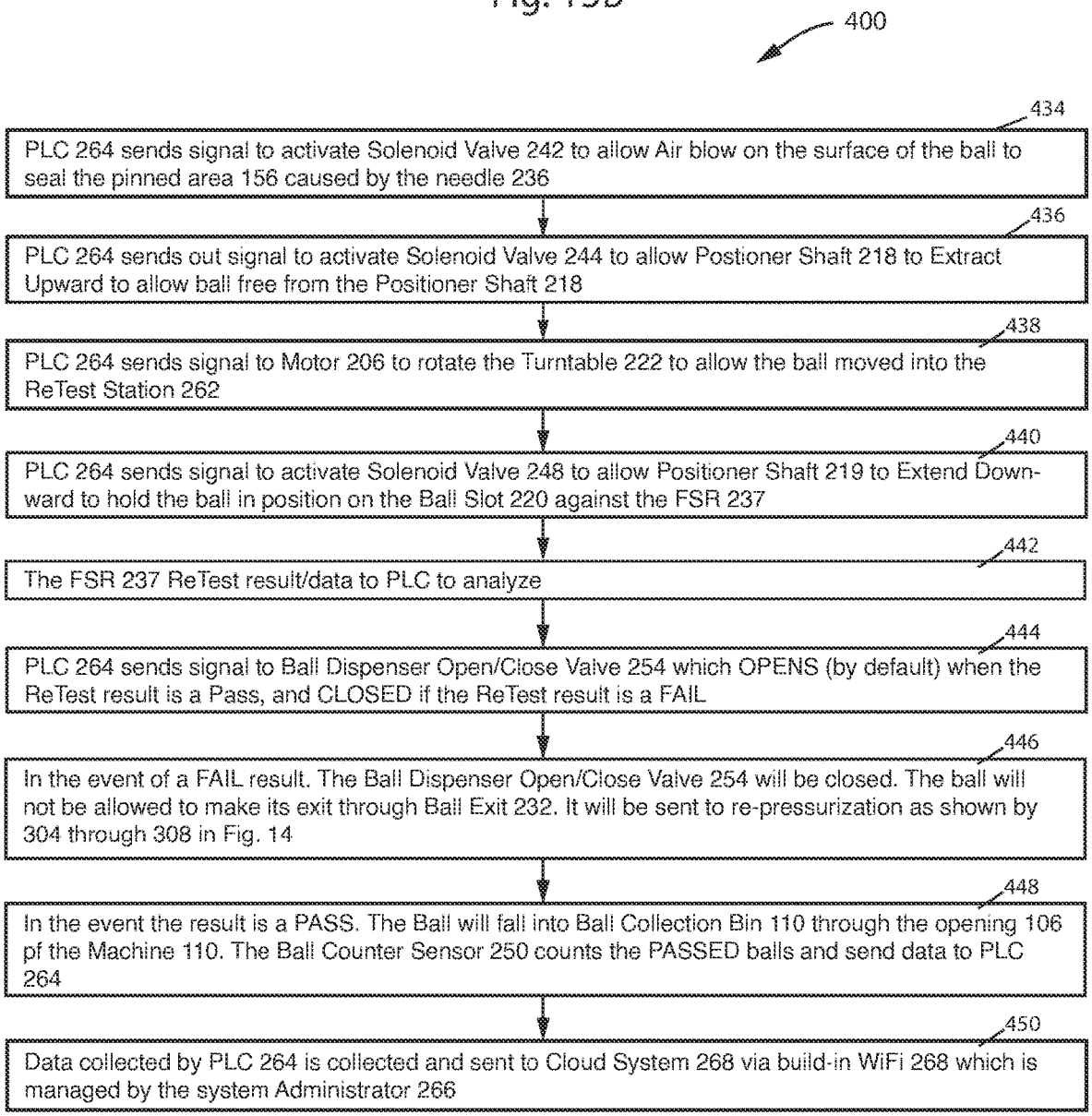

FIGS. 15A-15B shows a flow chart 400 of a second method, which includes a multiple step process for a procedural cycle from activation of the machine 100 to the data collection of the cloud system.

At step 402, the self-serving vending machine 100 is powered up, such as through a magnetic Card 108 insertion or a QR code scanning 104. At step 404, PLC 264 signals the ball feeder 102 to agitate to allow ball 150*a* to fall into the ball slot 204 of the turntable 222. At step 406, the sensor 256 detects the incoming ball 150*a* and sends a signal to the PLC 264. At step 408 the PLC 256 send out a signal to cause the motor 206 to rotate the turntable 222 to the pretest station 208. At step 410, the PLC 256 sends out a signal to activate the solenoid valve 246 to cause the positioner shaft 210 to extend downward to press the ball 150*a* on the FSR 258 surface to collect data. At step 412, the PLC 256 send out signal to activate the solenoid valve 246 to allow the positioner shaft 210 to extend downward to press the ball on the FSR 258 surface to collect data. At step 414, the FSR 258 sends test result/data to PLC 264. At step 416, PLC 264 analyzes the data and calculates the amount of air needed to pump into the ball 150*a* as shown by FIG. 5A and FIG. 5B. At step 418, the PLC 264 sends a signal to the motor 206 to rotate the turntable 222 to allow the ball into the ball slot 220. At step 420, the photoelectric switch sensor 224 detects the ball 150*a* in the ball slot 220 and sends a signal to the PLC 264.

At step 422, PLC 264 sends the signal to activate the solenoid valve 244 to allow the positioner shaft 218 to extend downward to hold the ball in position in the ball slot 220. At step 424, the PLC 264 sends a signal to activate the solenoid valve 240 to allow the tubing shaft 226 to extend upward. At step 426, the PLC 264 sends a signal to activate the solenoid valve 238 to allow the sealant pump shaft 228 to extend upward to pump sealant from the sealant container 260 into the tubing Shaft 226. At step 428, sealant is injected into the ball 150*a* via the needle 236 through the opening 236*a* of the base plate 235. At step 430, the PLC 264 sends a signal to activate the solenoid valve 242 to cause air to be pumped into the ball 150*a*. The amount of air caused to be pumped into the ball 150*a* is based on step 410. At step 432, the PLC sends a signal to activate Solenoid Valve 240 to allow the pressurization assembly stroke to extract.

At step 434 PLC 264 sends signal to activate solenoid valve 242 to allow air to blow on the surface of the ball 150*a* to seal the pinned area 156 caused by the needle 236. At step 436 PLC 264 sends out a signal to activate solenoid valve 244 to cause positioner shaft 218 to extract upward to allow ball 150*a* to be free from the positioner shaft 218. At step 438, the PLC 264 sends a signal to the motor 206 to rotate the turntable 222 to cause the ball 150*a* to be moved into the retest station 262. At step 440, the PLC 264 sends a signal to activate the solenoid valve 248 to allow the positioner shaft 219 to extend downward to hold the ball 150*a* in position on the ball slot 220 against the FSR 237. At step 442, the FSR 237 re test result/data to PLC 264 to analyze. At step 444, the PLC 264 sends a signal to ball dispenser open/close valve 254 which opens (by default) when the retest result is a pass, and closed if the retest result is a fail. At step 446, in the event of a fail result, the ball dispenser open/close valve 254 will be closed. The ball 150*a* will not be allowed to make its exit through ball exit 232. The ball 150*a* will instead be sent to re-pressurization as shown by processes 304 through 308 in FIG. 14.

At step 448, In the event the result is a pass, the ball 150*a* will fall into ball collection bin 110 through the opening 106 of the machine or apparatus 110. The ball counter sensor 250 counts the passed balls and sends data to the PLC 264. At step 450 data is collected by PLC 264 and sent to cloud system 268 via built-in WiFi 268 which is managed by the system Administrator 266.

Figure 16:
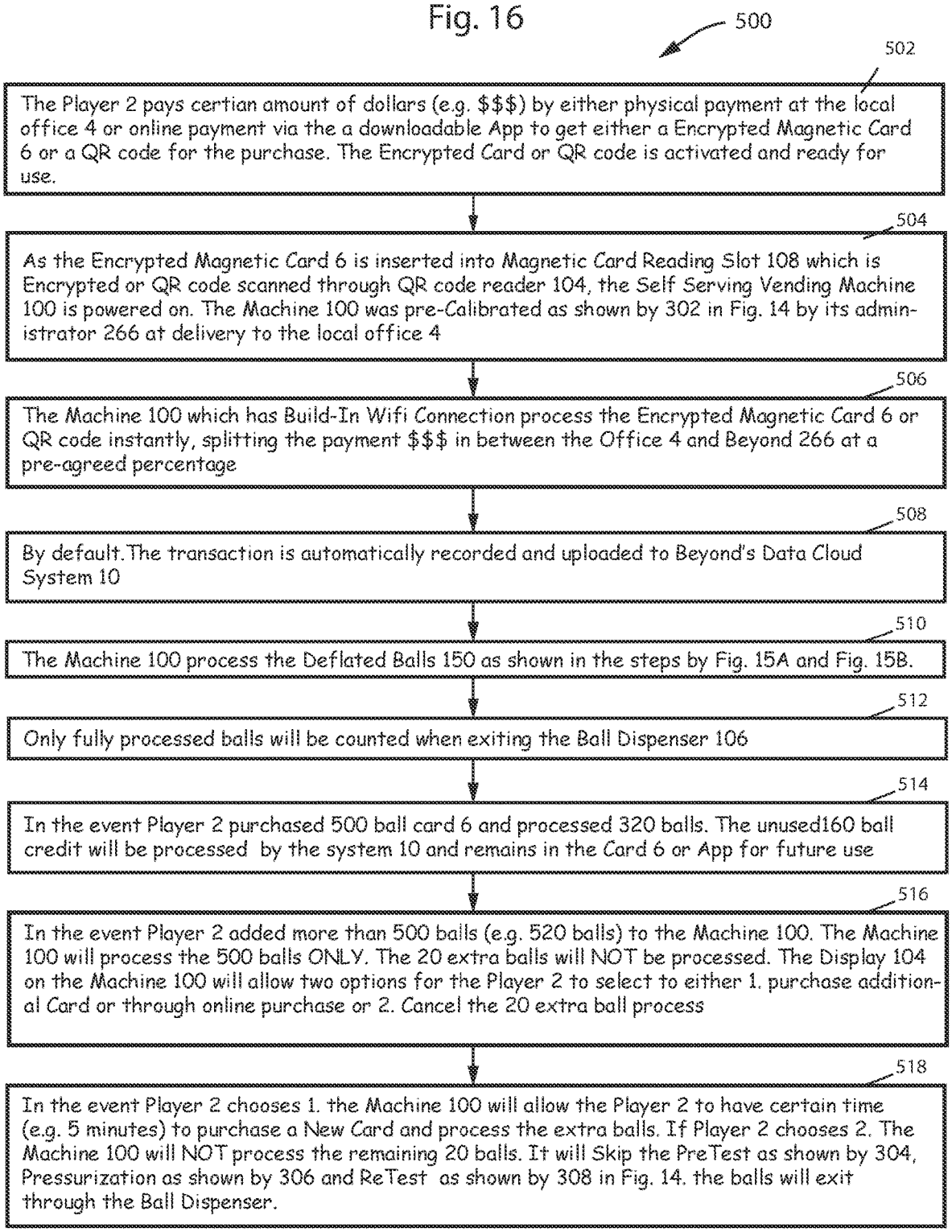
FIG. 16 is a flow chart of a third method, which includes a multiple step process for a procedural cycle from the initial payment to the receiving of the final processed balls from the payment.

FIG. 16 is a flow chart 500 of a third method, which includes a multiple step process for the procedural cycle from the initial payment to the receiving of the final processed balls from the payment.

At step 502, the Player 2 pays a certain amount of dollars (e.g. $$$) by either physical payment at the local office 4 or online payment via a downloadable App to get either an Encrypted Magnetic Card 6 or a QR code for the purchase. The Encrypted Card or QR code is activated and ready for use.

At step 504, as the encrypted magnetic card 6 is inserted into the magnetic card reading slot 108 which is encrypted or QR code scanned through QR code reader 104, the self-serving vending machine 100 is powered on. The machine 100 was pre-calibrated as shown by process 302 in FIG. 14 by its administrator 266 at delivery to the local office 4.

At step 506, the machine 100 which has Built-In Wifi connection, processes the encrypted Magnetic Card 6 or QR code instantly, splitting the payment $$$ in between the Office 4 and Beyond 266 at a pre-agreed percentage. At step 508, by default, the transaction is automatically recorded and uploaded to Beyond's data cloud system 10. At step 510, the machine 100 processes the deflated Balls 150 as shown in the steps by FIG. 15A and FIG. 15B.

At step 512, only fully processed balls will be counted when exiting the ball dispenser 106. At step 514, in the event player 2 purchased five hundred ball card 6 and processed three hundred and twenty balls. The unused one hundred and eighty ball credit will be processed by the system 10 and remains in the card 6 or computer software Application for future use.

At step 516, in the event player 2 added more than five hundred balls (e.g. five hundred and twenty balls) to the machine 100, the machine 100 will process the five hundred balls only. The twenty extra balls will not be processed. The display 104 on the machine 100 will allow two options for the player 2 to select to either (1) purchase additional card or through online purchase or (2) cancel the twenty extra ball process.

At step 518, In the event player 2 chooses (1) of step 516, the machine 100 will allow the player 2 to have certain time (e.g. 5.0 minutes) to purchase a new card and process the extra balls. If the player 2 chooses (2) of step 516, the machine 100 will not process the remaining twenty balls. The machine 100 as controlled by control 264 (programmed by computer software), will skip the pretest as shown by process 304. Pressurization as shown by process 306 and retest as shown by process 308 in FIG. 14, the balls of the balls 150, will exit through the ball dispenser 232.

In at least one embodiment, unless there is a significant change in the property and elasticity of the rubber of the tennis ball (such as where the ball is broken, leaking, aging etc.) being subject to a pressurization process as described previously, the pressurization process can be done multiple times on the same tennis ball, such as one of tennis balls 150 because of (1) a thin needle is used for the needle 236, such as a needle of 25.0 gauge or thinner, which is critical in at least one embodiment. It is critical, in at least one embodiment, that the needle 236 be thin enough to allow flow of sealant and air at the same time and use the elastic nature of the rubber to at least seal the hole as the needle 236 is withdrawn from the ball 150*a*. A bigger hole caused by thicker needle will cause the opposite result. In addition, the sealant should (a) have a very high viscosity, such as close to the viscosity of water, to pass through the needle 236 and seal the inner wall of the ball 150*a*; and (b) allow certain time to dry (or may not even have to dry as long as the hole is sealed). A sealant, such as "Slime Flat Tire Puncture Repair Sealant" may be used if particles in this sealant that may cause blockage to the needle 236 are filtered out substantially and if possible completely, but it is also possible that other sealants may be used.

In at least one embodiment, a process implemented by the second apparatus 200 as part of apparatus 100 and/or in connection with process 1, only takes fifteen seconds to get a tennis ball, such as tennis ball 150*a* to complete pressurization and the amount of air, sealant, and blowing are controllable by the control circuit 264, and this provides the ability to do batch or mess production/pressurization on hundreds and thousands of balls, which could not previously be done.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

a control circuit including a computer processor and a computer memory configured to be programmed with computer software for controlling the computer processor;

a first test assembly which is controlled by the control circuit;

a pressurization assembly which is controlled by the control circuit; and a sealant assembly which is controlled by the control circuit;

wherein the first test assembly in response to the control circuit causes-a-an initial test of the air pressure within an inner chamber of a first tennis ball when the first tennis ball is at a first location;

wherein the inner chamber of the first tennis ball is completely sealed and surrounded by an outer skin of the first tennis ball;

wherein, if the control circuit determines that the air pressure within the inner chamber of the first tennis ball is below a minimum threshold when the first tennis ball is at the first location, the control circuit causes the pressurization assembly to implement a pressurization process which includes causing the pressurization assembly to pierce the outer skin of the first tennis ball with a needle, to form a first opening in the outer skin, until a tip of the needle is in the inner chamber, and wherein the needle acts as a plug in the first opening while the tip of the needle is within the inner chamber of the first tennis ball;

wherein while the tip of the needle is within the inner chamber of the first tennis ball, the sealant assembly is configured to inject sealant through the needle into the inner chamber of the first tennis ball during a sealant process;

wherein while the tip of the needle is within the inner chamber of the first tennis ball, the pressurization assembly is configured to inject air through the needle into the inner chamber of the first tennis ball during the pressurization process;

wherein after sealant has been injected into the inner chamber as part of the sealant process and air has been injected into the inner chamber as part of the pressurization process the pressurization assembly in response to the control circuit causes the needle tip to be withdrawn from the inner chamber of the first tennis ball, and the needle to be withdrawn from the first opening.

2. The apparatus of claim 1 wherein as part of the sealant process, the sealing assembly in response to the control circuit causes air to be blown on the sealant after the pressurization assembly causes the needle tip to be withdrawn from the inner chamber of the first tennis ball, and the needle to be withdrawn from the first opening to help the sealant dry to seal the first opening.

3. The apparatus of claim 1 further comprising a ball feeder which is configured to supply the first tennis ball to the first location for the initial test, from a plurality of tennis balls within the ball feeder.

4. The apparatus of claim 1 further comprising a work station turntable which is configured to receive a first tennis ball into a ball slot; and wherein the work station turntable is configured to turn to bring the first tennis ball in the ball slot to the first location wherein the first test assembly is configured to cause the initial test of the air pressure within the inner chamber of the first tennis ball.

5. The apparatus of claim 4 wherein the work station turntable is configured to turn to bring the first tennis ball in the ball slot to a second location, which is different from the first location, and at the second location the control circuit causes the pressurization assembly to implement the pressurization process.

6. The apparatus of claim 4 further comprising a sealant anti-backflow system;

an air anti-backflow system; and wherein the sealant anti-backflow system controls the sealant flow into the ball and the air anti-backflow system controls the air flow into the ball as controlled by the control circuit in a manner so that if the sealant anti-backflow system is open, then the air anti-backflow system is closed and if the air anti-back flow system is open then the sealant anti-backflow system is closed.

7. The apparatus of claim 1 further comprising a second test assembly which is controlled by the control circuit; and wherein the second test assembly in response to the control circuit causes a retest of the first tennis ball, which is a test of the air pressure within the inner chamber of the first tennis ball after the first tennis ball has been subject to the pressurization process and to the sealant process.

8. The apparatus of claim 6 wherein if the control circuit determines from the retest of the first tennis ball that the air pressure within the inner chamber of the first tennis ball is less than a threshold, then the control circuit is configured to cause the pressurization process and the sealant process to be applied to the first tennis ball again.

9. A method comprising the steps of:

determining average new ball pressure of a plurality of tennis balls during a calibration phase;

determining one or more of the plurality of tennis balls is deflated, such that the one or more of the plurality of tennis balls has a pressure below a threshold pressure; and adding air pressure to inner chambers of each of the one or more of the plurality of tennis balls that were determined to be deflated so that each of the inner chambers of each of the one or more tennis balls have a minimum threshold pressure; and wherein the step of adding air pressure includes piercing an outer skin of each of the one or more of the plurality of tennis balls with a needle, and using the needle to add air pressure to each of the one or more of the plurality of tennis balls.

10. A method comprising performing an initial test by testing air pressure within an inner chamber of a first tennis ball when the first tennis ball is at a first location, wherein the inner chamber of the first tennis ball is completely sealed and surrounded by an outer skin of the first tennis ball;

if it is determined by the initial test, that the air pressure within the inner chamber of the first tennis ball is below a minimum threshold when the first tennis ball is at the first location, implementing a pressurization process which includes causing a needle to pierce the outer skin of the first tennis ball to form a first opening in the outer skin until a tip of the needle is within the inner chamber and wherein the needle acts as a plug in the first opening, while the tip of the needle is within the inner chamber of the first tennis ball;

while the tip of the needle is within the inner chamber of the first tennis ball, injecting sealant through the needle into the inner chamber of the first tennis ball during a sealant process;

while the tip of the needle is within the inner chamber of the first tennis ball, injecting air through the needle into the inner chamber of the first tennis ball during the pressurization process;

after sealant has been injected into the inner chamber as part of the sealant process and air has been injected into the inner chamber as part of the pressurization process, withdrawing the needle tip from the inner chamber of the first tennis ball, and the needle from the first opening.

11. The method of claim 10 further comprising:

as part of the sealant process, blowing air on the sealant after withdrawing the needle tip from the inner chamber of the first tennis ball, and the needle from the first opening.

12. The method of claim 10 further comprising feeding the first tennis ball to the first location for the initial test, from a plurality of tennis balls.

13. The method of claim 10 further comprising receiving the first tennis ball into a ball slot; and bringing the first tennis ball in the ball slot to the first location wherein the first test assembly is configured to cause the initial test of the air pressure within the inner chamber of the first tennis ball.

14. The method of claim 13 further comprising bringing the first tennis ball in the ball slot to a second location, which is different from the first location, and at the second location implementing the pressurization process.

15. The method of claim 10 further comprising performing a retest of the first tennis ball, which is a test of the air pressure within the inner chamber of the first tennis ball after the first tennis ball has been subject to the pressurization process and to the sealant process.

16. The method of claim 14 further comprising applying the pressurization process and the sealant process to the first tennis ball again if it is determined from the restest of the first tennis ball that the air pressure within the inner chamber of the first tennis ball is less than a threshold.

17. The apparatus of claim 2 wherein the sealing assembly in response to the control circuit causes air to be blown on the sealant by supplying air through the needle, which helps to clean the inside of the needle.

* * * * *